US006688787B2

(12) United States Patent
Arakawa et al.

(10) Patent No.: US 6,688,787 B2
(45) Date of Patent: Feb. 10, 2004

(54) ROLLER DEVICE AND ELECTRONICS USING THE ROLLER DEVICE

(75) Inventors: Toru Arakawa, Hyogo (JP); Masaaki Matsui, Osaka (JP); Kenji Nakasono, Osaka (JP); Toshio Tanaka, Kyoto (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 30 days.

(21) Appl. No.: 09/959,547

(22) PCT Filed: Mar. 2, 2001

(86) PCT No.: PCT/JP01/01647

§ 371 (c)(1),
(2), (4) Date: Feb. 8, 2002

(87) PCT Pub. No.: WO01/64450

PCT Pub. Date: Sep. 7, 2001

(65) Prior Publication Data

US 2002/0158409 A1 Oct. 31, 2002

(30) Foreign Application Priority Data

| | | |
|---|---|---|
| Mar. 2, 2000 | (JP) | 2000-056796 |
| Mar. 29, 2000 | (JP) | 2000-090354 |
| Mar. 29, 2000 | (JP) | 2000-090355 |
| Mar. 29, 2000 | (JP) | 2000-090356 |
| Dec. 28, 2000 | (JP) | 2000-400459 |

(51) Int. Cl.[7] ..... B41J 29/38; B41J 23/02

(52) U.S. Cl. ..... 400/120.16; 400/648; 400/659; 400/613; 475/342

(58) Field of Search ..... 400/120.16, 120.17, 400/88, 648, 659; 347/197, 198; 475/317, 342, 149

(56) References Cited

U.S. PATENT DOCUMENTS

| | | | | |
|---|---|---|---|---|
| 4,039,065 A | * | 8/1977 | Seki et al. | 400/120.16 |
| 4,420,762 A | * | 12/1983 | Andrews | 346/136 |
| 5,114,251 A | * | 5/1992 | Mahoney | 400/120.16 |
| 5,694,159 A | * | 12/1997 | Kajiya et al. | 347/197 |
| 6,270,271 B1 | * | 8/2001 | Fujiwara | 400/693 |

FOREIGN PATENT DOCUMENTS

| | | | | |
|---|---|---|---|---|
| EP | 870620 A2 | * | 10/1998 | B41J/11/20 |
| JP | 01008055 A | * | 1/1989 | B41J/11/20 |

(List continued on next page.)

OTHER PUBLICATIONS

IBM Technical Disclosure Bulletin, "Platen Index Motor Mounted Within Platen," Feb. 1987, vol. 29, Issue 9 , pp. 4163–4164.*

Machine Translation of JP 08–058164 from Japanese Patent Office website.*

*Primary Examiner*—Daniel J. Colilla
(74) *Attorney, Agent, or Firm*—Wenderoth, Lind & Ponack L.L.P.

(57) ABSTRACT

A roller device includes a motor and a speed reducer inside a cylindrical roller or arranged coaxially, and an electronic apparatus includes a printer using the roller device. This roller device comprises a motor (5) disposed on a cylindrical roller (2), a sun gear (7), planet gears (8), a first inner tooth gear (10) provided inside of the cylindrical roller (2), and a second inner tooth gear (11) provided inside of a bearing element (12). The rotation of the bearing element (12) is suppressed by a predetermined force. Thus the rotation of the motor (5) is decelerated, and the cylindrical roller is rotated at a reduced speed. By rotating the bearing element with a force greater than a predetermined force, the cylindrical roller can be rotated manually.

36 Claims, 27 Drawing Sheets

FOREIGN PATENT DOCUMENTS

| | | | | |
|---|---|---|---|---|
| JP | 01136773 A | * | 5/1989 | ..... B41J/11/20 |
| JP | 2-022635 | | 1/1990 | |
| JP | 2-279363 | | 11/1990 | |
| JP | 3-108571 | | 5/1991 | |
| JP | 5-162887 | | 6/1993 | |
| JP | 5-187485 | | 7/1993 | |
| JP | 8-73061 | | 3/1996 | |
| JP | 08058164 A | * | 3/1996 | ..... B41J/11/04 |
| JP | 8-133506 | | 5/1996 | |
| JP | 8-156144 | | 6/1996 | |
| JP | 10-279117 | | 10/1998 | |

* cited by examiner

ROLLER DEVICE AND ELECTRONICS USING THE ROLLER DEVICE

TECHNICAL FIELD

The present invention relates to a roller device as a paper feeder for a printer or the like, and an electronic apparatus such as printer using the roller device.

BACKGROUND ART

In a conventional electronic apparatus including a printing unit such as a printer, in most cases, a roller for feeding paper is arranged parallel with a motor for driving the roller and some of the gears for reducing the rotating speed of the motor. This is because the rotation of the motor needs to be transmitted to the roller after the speed is reduced, from the driving gear fixed to the motor through plural driving gears arranged in parallel thereto. As a result, the size of the entire printer becomes large.

Recently, however, as the printers and other electronic apparatuses are becoming smaller and smaller in size, the driving mechanism of cylindrical roller is required to be reduced in size. For example, has been proposed to incorporate a driving mechanism in the cylindrical roller as disclosed in Japanese Laid-open Patent No. 2-22635. This publication discloses a cylindrical roller with both ends being open, a motor accommodated at one end in this cylindrical roller, a sun gear disposed on the shaft of the motor in the cylindrical roller, planet gears engaging with the sun gear in the cylindrical roller, a cylindrical roller having a first inner tooth gear provided at the inner side of the cylindrical roller opposite to the planet gears and having a second inner tooth gear fixed to the motor and engaging the planet gears, and a drive mechanism thereof.

In this example, the second inner tooth gear is fixed to the motor. Therefore, the cylindrical roller cannot be rotated manually (if required) when feeding paper or setting paper. In other words, the first inner tooth gear of the cylindrical roller engages the second inner tooth gear through the planet gears. However, the second inner tooth gear is fixed to the motor. This motor is fixed to the fixing unit outside of the opening at one end of the cylindrical roller. The cylindrical roller cannot be turned manually and if it is attempted to turn the roller by force, the planet gears and the first and second inner tooth gears will be broken.

Meanwhile, the conventional electronic apparatus of this kind comprises, in most cases, a main body case, a sheet receiver disposed in the main body case, a roller for holding the printing sheet together with the sheet receiver, and a head for recording information on the printing sheet in the main body. Therefore, the roller is rotated while the printing sheet is being held between the roller and the sheet receiver. Thus, the printer supplies the printing sheet into the head unit, and discharges the printing sheet on which the information is recorded by the head to outside of the main body case. In this configuration, after a change of sheets, for example, it is predicted that the operation of the roller may not be secure as mentioned below.

When changing sheets, the roller needs to be separated from the sheet receiver by disconnecting the roller and a driving element such as a motor disposed outside of the roller. Therefore, in most cases hitherto, the roller and the driving element were coupled by plural gears. By disconnecting these gears, the roller can be separated from the sheet receiver.

After changing the sheets, when holding the printing sheet between the roller and sheet receiver again, the plural gears engage each other, and are coupled. The gears can engage smoothly as long as the tops and bottoms of the teeth are appropriately facing, each other. However, the tops and bottoms of the teeth are not always facing appropriately, and the gear may be deformed due to mutual collision between tops. Thus, the subsequent power transmission, that is, the roller operation may not be secure.

SUMMARY OF THE INVENTION

It is hence an object of the invention to prevent damage to the planet gears, and first and second inner tooth gears when manually rotating the cylindrical roller used in a printer or the like.

It is another object of the invention to feed the printing sheet manually by manually rotating the cylindrical roller.

It is a further object of the invention to present an electronic apparatus including a printer having a compact design.

It is still another object of the invention to present an electronic apparatus including a printer for operating the roller securely.

To achieve these objects, the roller device of the present invention includes a cylindrical roller with both ends open, a motor having a motor shaft accommodated at one end in the cylindrical roller, a sun gear disposed on the motor shaft in the cylindrical roller, and planet gears engaging the sun gear in the cylindrical roller. A bearing element has a first inner tooth gear provided at the inner side of the cylindrical roller opposite to the planet gears, and has a second inner tooth gear engaging the planet gears, and at least a support shaft of the bearing element is disposed at another end of the cylindrical roller. A bearing mechanism supports the cylindrical roller rotatably on the bearing element. At one end of the cylindrical roller, a fixing unit of the motor is provided, and the rotation of the second inner tooth gear is defined by a predetermined force.

According to this configuration, the cylindrical roller can be rotated by the rotating force of the motor, at a rotating speed and torque adequate for feeding paper. In addition, when a rotating force more than a specified value is applied to the cylindrical roller or the support shaft of the bearing element in their rotating direction, the support shaft of the bearing element rotates the cylindrical roller by way of the second inner tooth gear, planet gears, and first inner tooth gear. As a result, the printing sheet can be fed manually. Thus, the printing sheet can be fed manually without damage to the planet gears or first and second inner tooth gears. The electronic apparatus including the printer device having such roller device presents a printer having a compact design, and operates the roller securely.

DETAILED DESCRIPTION OF THE PREFERRED EMBODIMENTS

Figure 1:
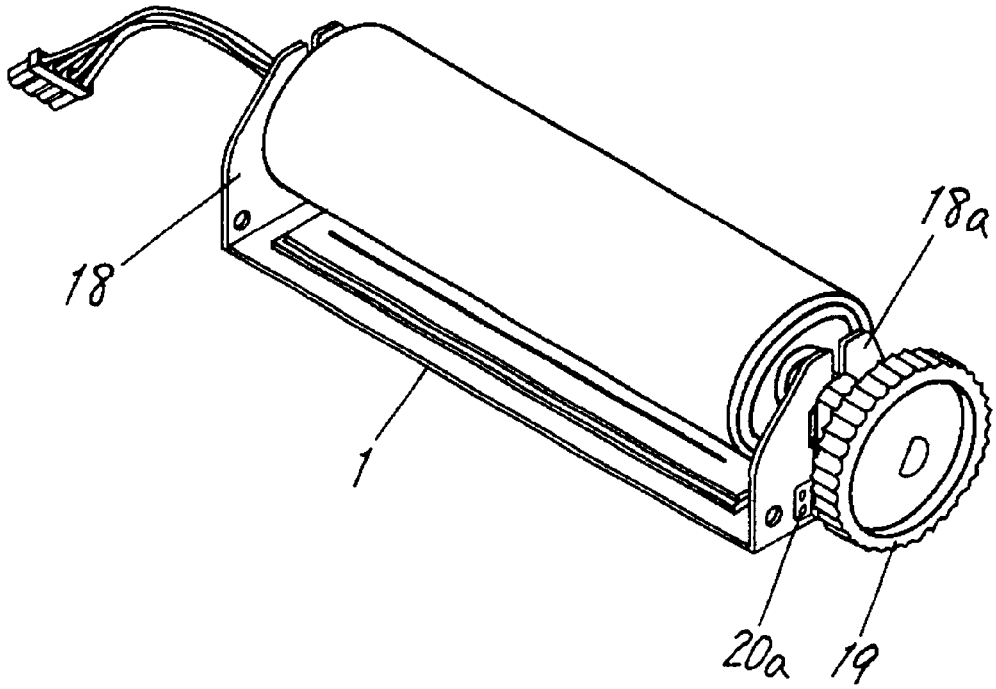
FIG. 1 is a perspective view of a cylindrical roller device in a first embodiment of the invention.
Figure 2:
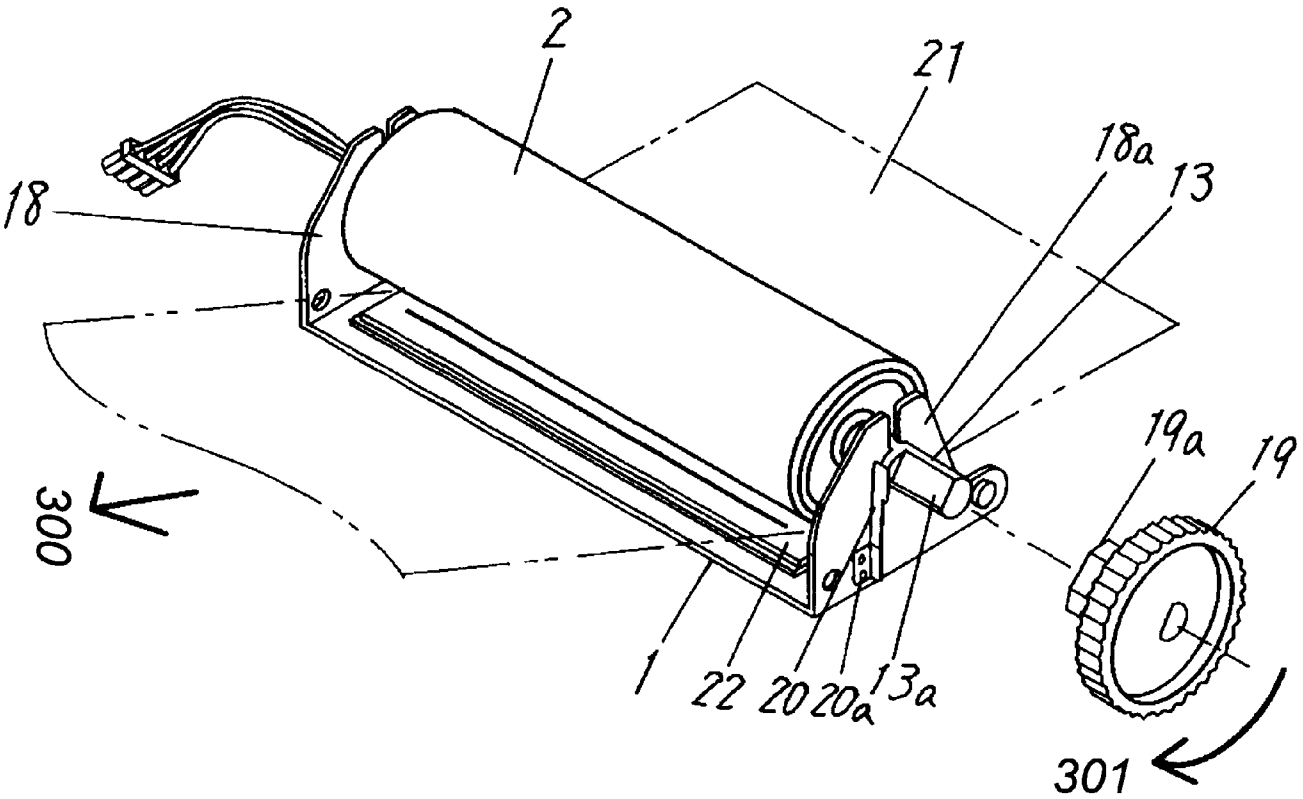
FIG. 2 is a perspective exploded view of the cylindrical roller device in the first embodiment.
Figure 3:
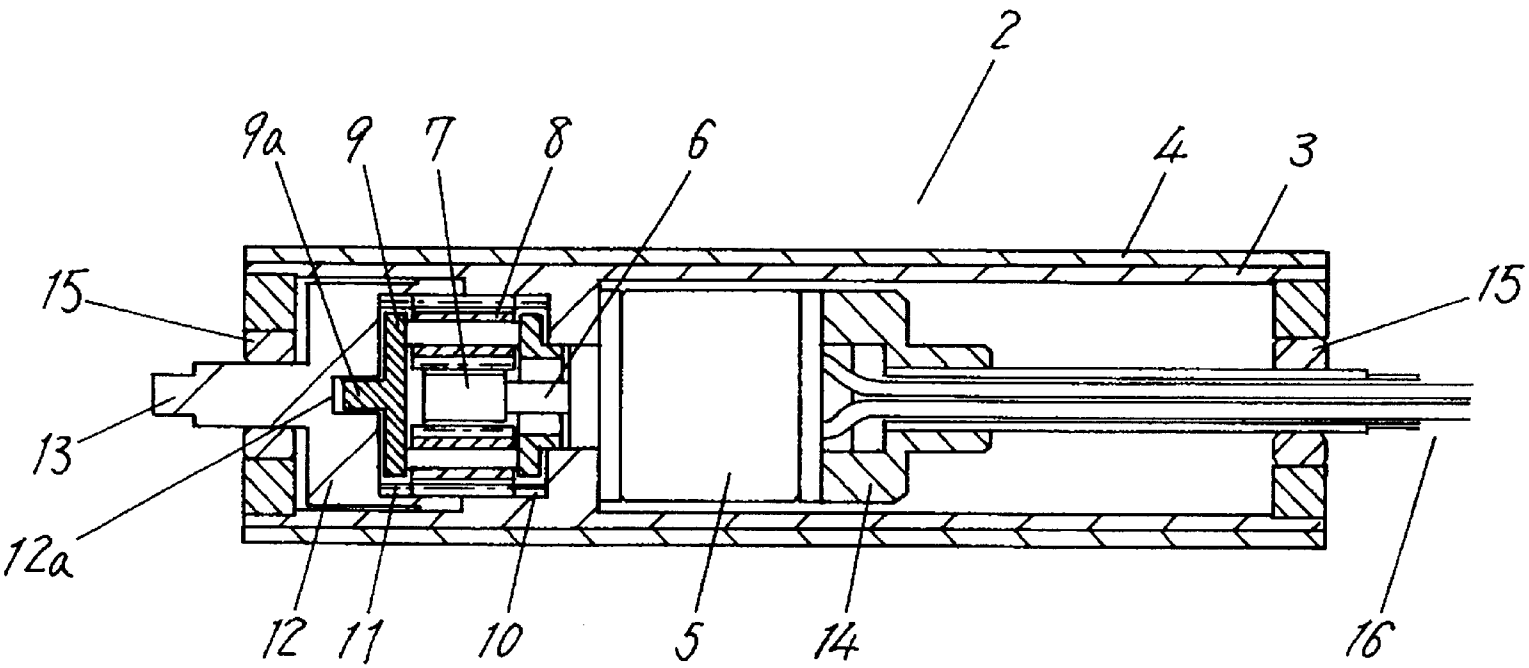
FIG. 3 is a sectional view of a cylindrical roller of the invention.

A first embodiment of the invention is described below by referring to the accompanying drawings. In FIG. 1 and FIG. 2, a cylindrical roller 2 is supported on a U-shaped base body 1 made of metal plate. The cylindrical roller 2 is, as shown in FIG. 3, formed by covering the outer circumference of a cylinder 3 (made of metal such as aluminum) with a cylinder 4 (made of an elastic material such as silicone rubber).

Figure 4:
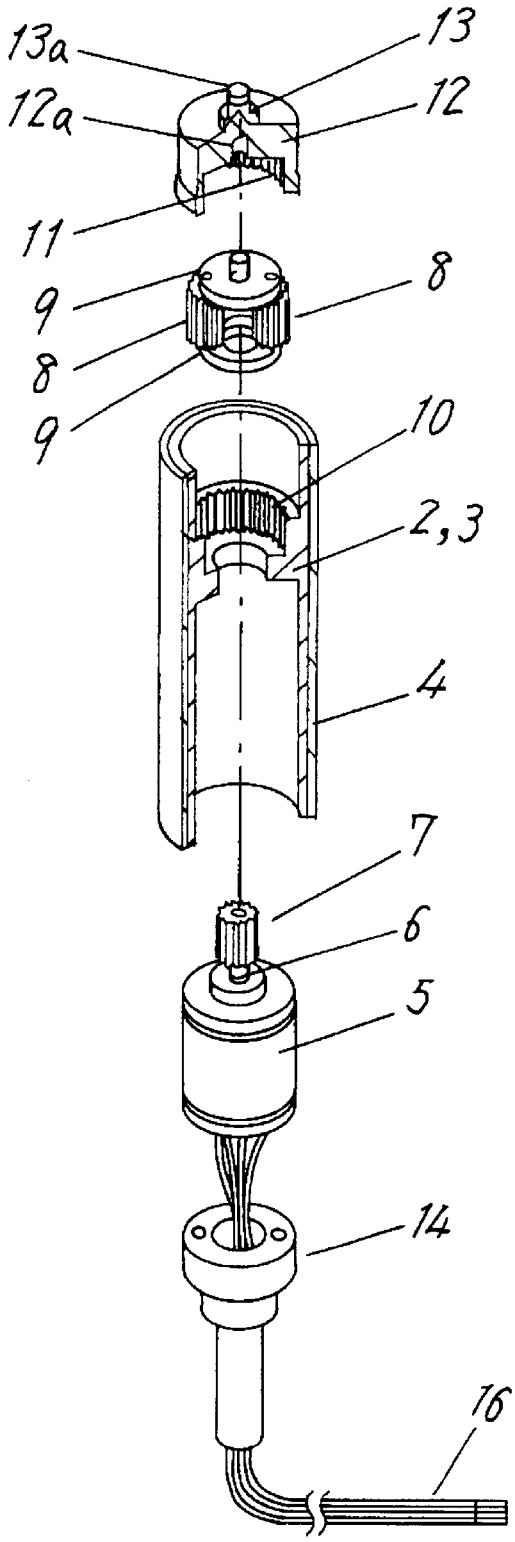
FIG. 4 is a perspective exploded view of a cylindrical roller portion of the invention.

In the cylindrical roller 2, a motor 5 is accommodated in a contact-free state. A sun gear 7 is coupled to a motor shaft 6 of the motor 5 as shown in FIG. 4. The sun gear 7 engages two planet gears 8. The two planet gears 8 are supported on a carrier 9 at a specific interval. The sun gear 7 engages the planet gears 8 from the inside.

A motor end portion of both of the planet gears, in turn, engage a first inner tooth gear 10 provided on an inside surface of the cylinder 3. A second inner tooth gear 11 engages a free-end portion of both planet gears 8 (i.e., an end opposite the motor-end).

The second inner tooth gear 11 is provided on the inner surface of a cap-shaped bearing element 12. A support shaft 13 is integrally provided on the bearing element 12 at an opening of cylinder 3 so that the support shaft 13 is located at a side of the bearing element 12 opposite the motor 5.

A shaft 9*a* of the carrier 9 is rotatably supported in a bottom recess 12*a* of the cap-shaped bearing element 12. The motor 5 is held by a support element 14. At a first open end of the cylinder 3, this support element 14 is fixed to a plate element 18 folded upward at a side of the base body 1 shown in FIG. 1 and FIG. 2. On the outer periphery of the support shaft 13 and support element 14, a bearing mechanism 15 is provided as shown in FIG. 3, and the cylinder 3 is rotatably supported. As shown in FIG. 4, a power feed line 16 is drawn inside of the cylinder 3 from outside of the cylinder 3 through a hollow space in the support element 14 for feeding power from outside of the cylinder 3 into the motor 5.

In a cylindrical roller with this type of a configuration, the number of teeth of the first inner tooth gear 10 should be, for example, 36, and the number of teeth of the second inner tooth gear 11 should be 34. The sun gear 7 rotates, and the planet gears 8 revolve around the sun gear 7. Since the two planet gears 8 engage the first inner tooth gear 10 and the second inner tooth gear 11, a rotation difference of two teeth (i.e., a deviation) occurs in one revolution of the planet gears 8.]

Figure 5A:
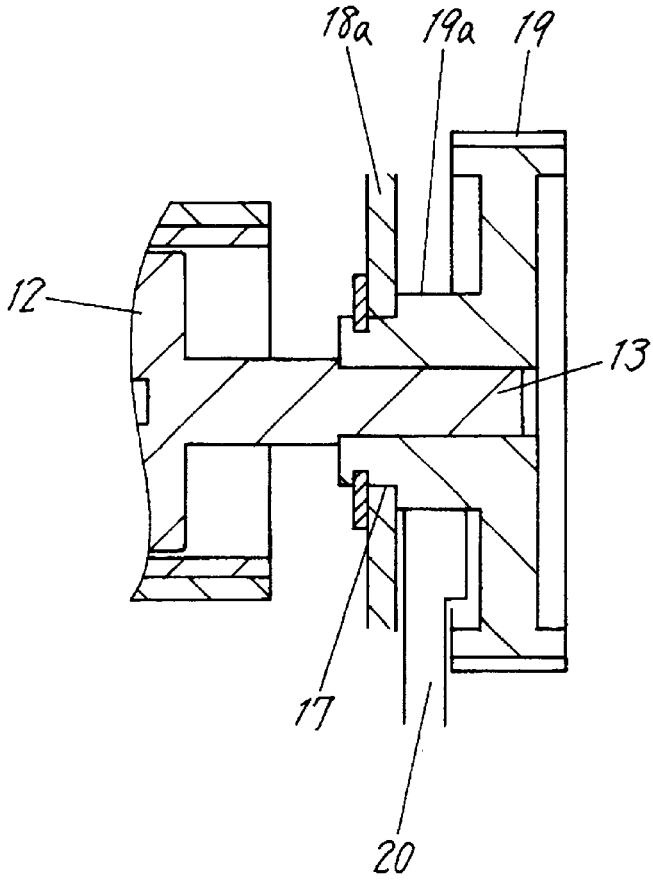
FIGS. 5A and 5B are essential sectional views of a cylindrical roller of the invention.
Figure 6A:
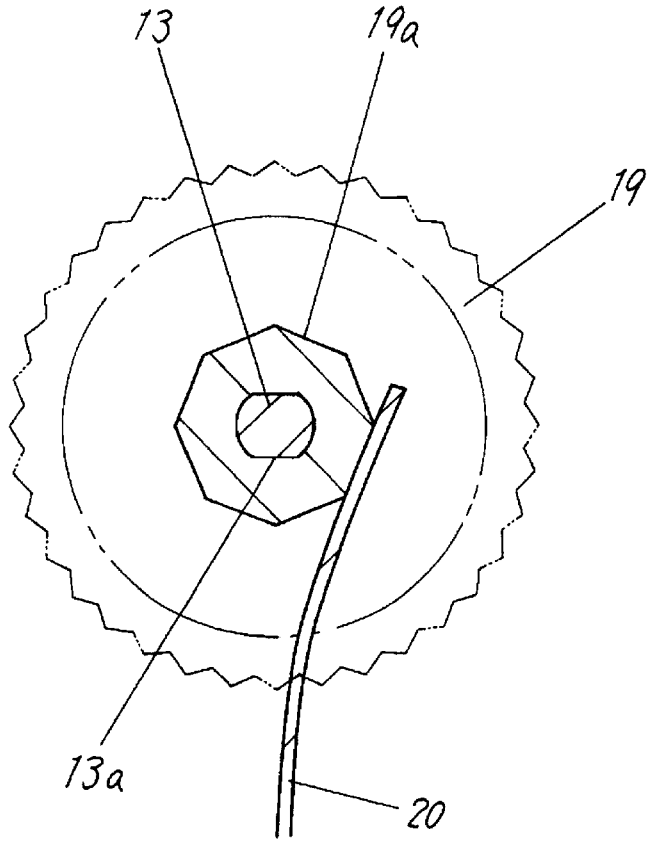
FIGS. 6A and 6B are essential side views of a cylindrical roller of the invention.

The support shaft 13 connected to the second inner tooth gear 11 penetrates through the plate member 18*a* having a through-hole 17 as shown in FIG. 1, FIG. 2, and FIG. 5A. On the outer circumference of a flat portion 13*a* of the support shaft 13, a rotation suppressor 19*a* is integrally formed on a rotation knob 19 made of synthetic resin. This rotation suppressor 19*a* has a polygonal, (specifically octagonal) outer circumference as shown in FIG. 6A. A free end of a plate spring 20 is pressed against the outer circumference, and the rotation is suppressed. The opposite side of the free end of the plate spring 20 is fixed to the plate member 18*a* by a screw 20*a*.

In this state, when power is supplied to the motor 5 through the power feed line 16, rotation of the sun gear 7 makes the planet gears 8 revolve, and deviation between the first inner tooth gear 10 and second inner tooth gear 11 occurs. At this time, the bearing element 12 having the second inner tooth gear 11 has its rotation arrested by the rotation suppressor 19, as mentioned above. However, the first inner tooth gear 10 and its integrated cylinder 3 rotate together with the cylinder 4.

At this time, the motor rotation varies depending on the difference in the number of teeth between the first inner tooth gear and second inner tooth gear, and the cylinders decelerate to a speed appropriate for feeding paper. The rotating speed of the motor is high and its torque is low, but as the speed is reduced in this manner, adequate speed and torque for feeding paper are obtained for the cylinders 3, 4 (that is, the cylindrical roller 2).

Due to, by the rotation of the cylindrical roller 2, a band of printing sheet 21 is conveyed in the direction of arrow 300 as shown in FIG. 2. The band of printing sheet 21 is a thermal paper, and a thermal head 22 is disposed at the side opposite to the cylindrical roller 2. At this time, along with feeding of the printing sheet 21, power is supplied to the thermal head 22, and the printing sheet 21 is printed. The printing sheet 21 is not limited to thermal paper, but a film or a card may be used.

At the end of the printing, that is, with no power supplied to the motor 5, when attempting to feed the printing sheet 21 in the direction of arrow 300, in this embodiment, the rotation knob 19 is turned in the direction of arrow 301 in FIG. 2. At this time, a rotating force more than a predetermined force, which is specified by the pressing force of the plate spring 20 to the rotation suppressor 19*a,* is applied to the rotation suppressor 19*a.* This rotating force is transmitted to the bearing element 12, the second inner tooth gear 11, planet gears 8 coupled thereto, and the first inner tooth gear 10. Consequently, the cylindrical roller 2 rotates step by step on every side of the polygon formed on the rotation suppressor 19*a.* As a result, the printing sheet 21 is fed manually in the direction of arrow 300 in FIG. 2.

Along with rotation of the second inner tooth gear 11, the planet gears 8 rotate and revolve around the sun gear fixed on the stopped motor shaft. Therefore, excessive force is not applied to the sun gear and motor.

According to this embodiment, since the support shaft of the bearing element is elastically pressed and held on the holding portion at the second end of the cylindrical roller, the cylindrical roller can be rotated at a proper speed and torque for feeding paper by the rotating force of the motor. In addition, the cylindrical roller can be turned manually, so that the printing sheet can be fed manually. Specifically, since the outer shape of the rotation suppressor is polygonal, and the plate spring is pressed to it, the cylindrical roller rotates step by step on each side of the polygon.

Figure 7:
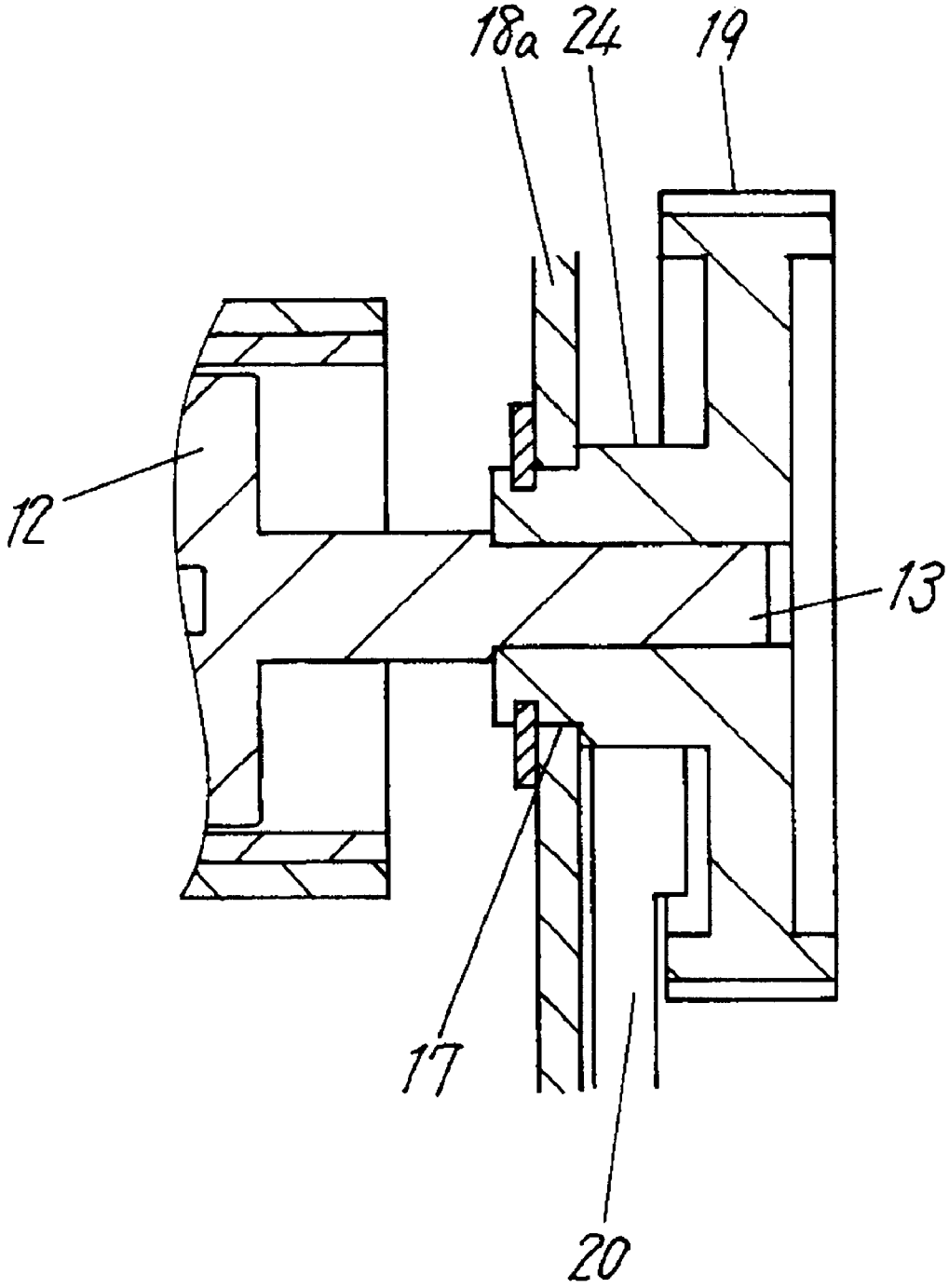
FIG. 7 is an essential sectional view of a second embodiment of the invention.
Figure 8:
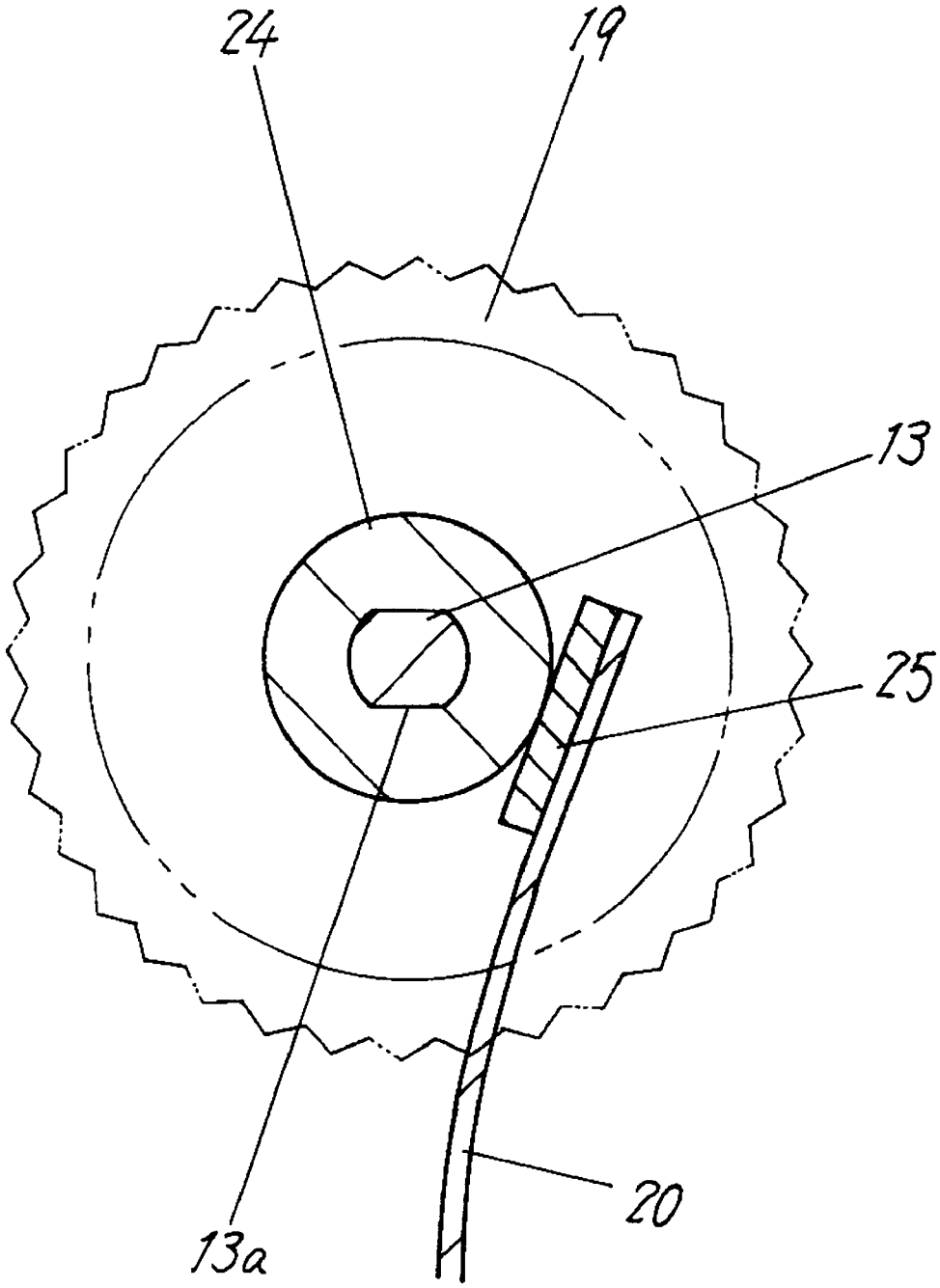
FIG. 8 essential side view of the second embodiment of the invention.

FIG. 7 and FIG. 8 show a second embodiment. Herein, a bearing element 12 and a support shaft 13 coupled and integrated with a second inner tooth gear 11 penetrate through a plate member 18*a* having a through-hole 17 as shown in FIG. 7. On the outer circumference of a flat portion 13*a* of this support shaft 13, a columnar rotation suppressor 24 integrated with a rotation knob 19 made of synthetic resin is provided. On the outer circumference of the rotation suppressor 24, a rubber piece 25 (as an example of friction member) is pressed by a plate spring 20, and the rotation of the support shaft 13 is suppressed. The rubber piece 25 is fixed to the free end of the plate spring 20. The other end of the plate spring 20 is, although not shown, fixed to the plate member 18*a* or the like in the same way as in FIG. 2.

In this configuration, due to the frictional force between the rubber piece 25 pressed by the plate spring 20 and the rotation suppressor 24, the rotation suppressing force of the support shaft 13 is heightened. By specifying the type and shape of the friction member, the rotation suppressing force can be properly set. That is, the rotating force of the rotation knob 19 can be adjusted. In other words, by varying the elastic force of the elastic element, the rotation starting force of the support shaft can be easily varied.

Figure 5B:
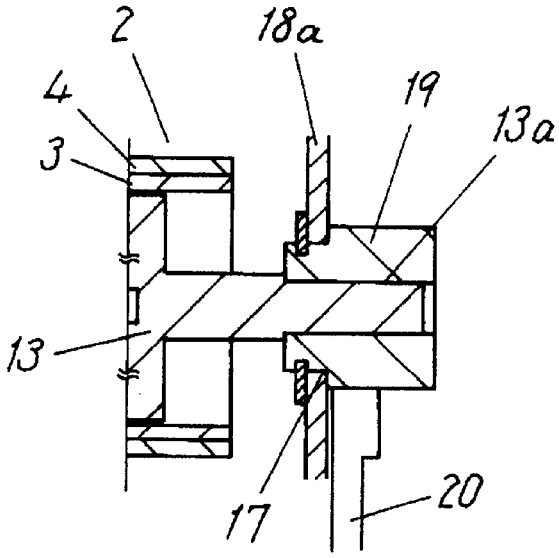
Figure 6B:
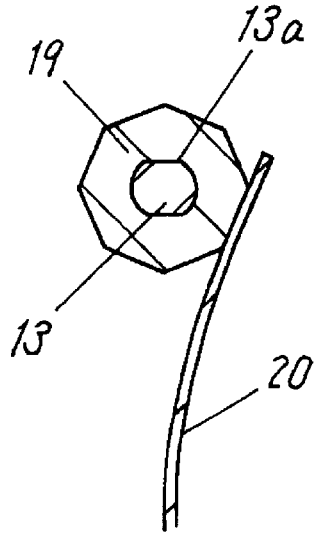

In the first and second embodiments, the rotation suppressor 19*a,* 24 is formed integrally with the rotation knob 19 made of synthetic resin. But as clear from the explanation so far, the rotation knob 19 is not always required to be formed integrally with the rotation suppressor 19*a,* 24. As shown in FIG. 5B or FIG. 6B, the roller device without a rotation knob may be used, and a proper rotation knob may be attached as required, or it may be attached to other driving elements. In addition, the rotation suppressor is not limited to synthetic resin, and may be formed of metal or other material.

Figure 9:
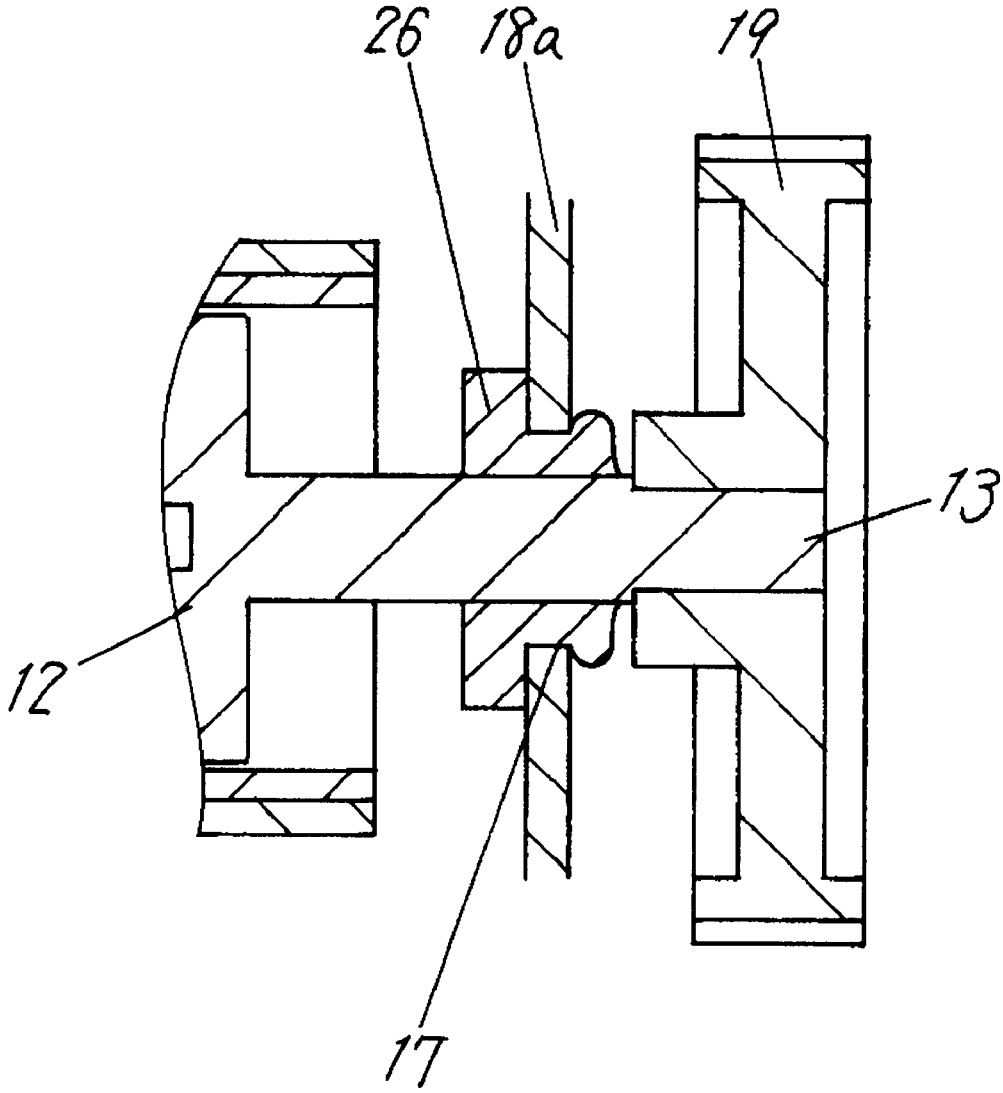
FIG. 9 is an essential sectional view of a third embodiment of the invention.

FIG. 9 shows a third embodiment. The support shaft 13 of the bearing element 12 integrated with the second inner tooth gear 11 shown in FIG. 3 penetrates through a hole of a rubber bushing 26. The hole has a smaller diameter than that of the support shaft 13. The support shaft 13 deforms the bush 26 elastically, and penetrates a through-hole 17. Due to the elasticity of the bush 26, the rotation of the support shaft 13 is suppressed. That is, the bush 26 adjusts the rotating force of the rotation knob 19. The support shaft 13 in FIG. 9 is columnar, and does not have a flat portion 13*a.*

In this embodiment, the rotation suppressing force of the support shaft is increased by the friction member, and by specifying the type and shape of the friction member, the rotation suppressing force can be set properly. Moreover, since the bushing alone can generate a rotation suppressing force on the support shaft, the structure is simple and smaller in size.

Figure 10:
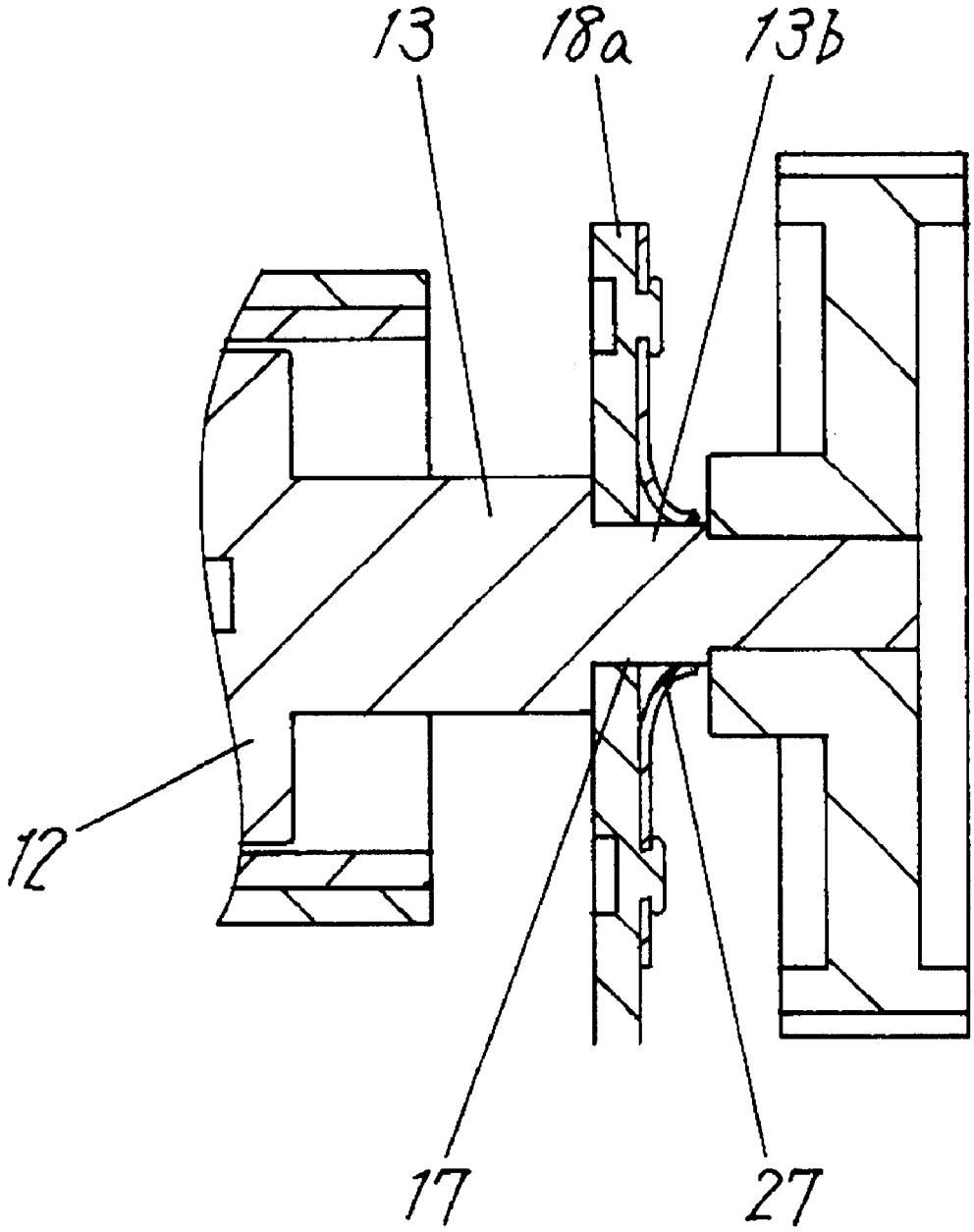
FIG. 10 is an essential sectional view of a fourth embodiment of the invention.
Figure 11:
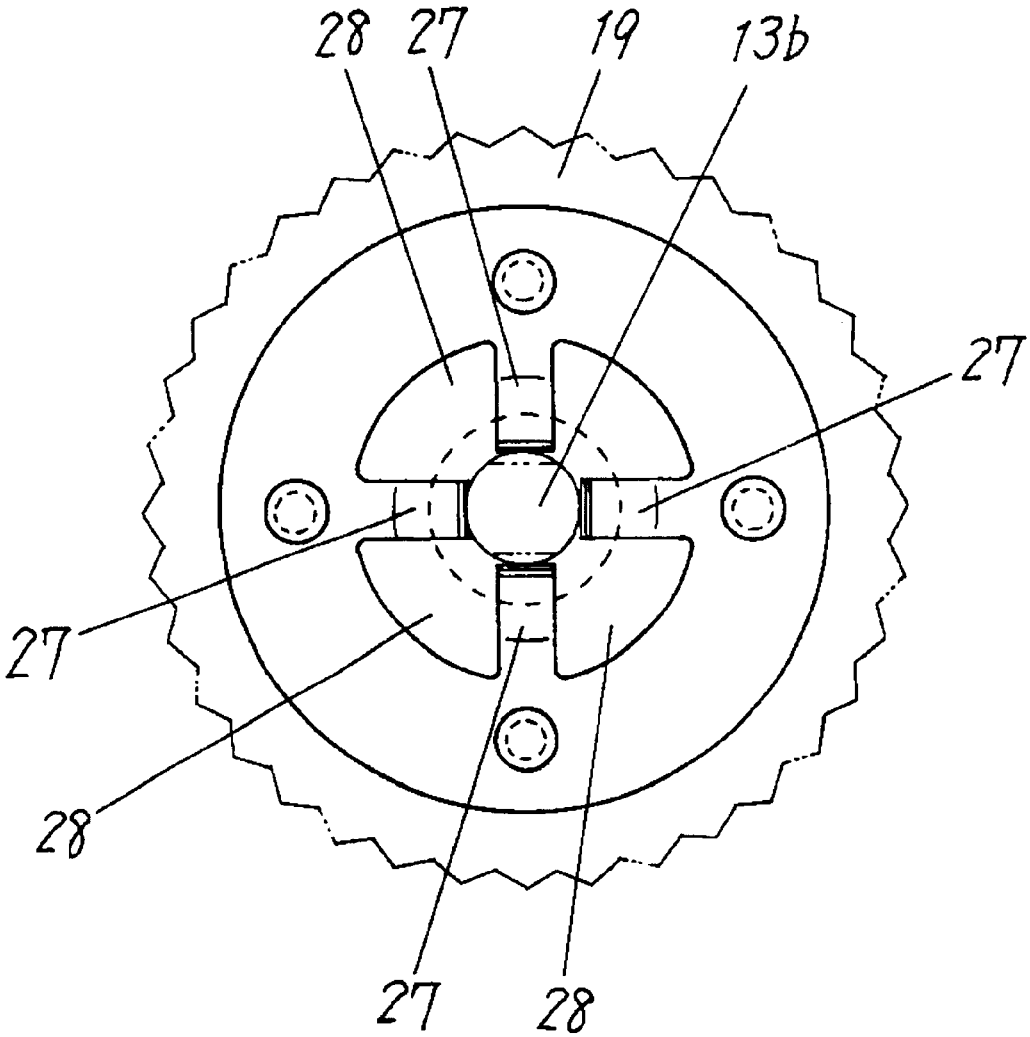
FIG. 11 is an essential side view of the fourth embodiment.

FIG. 10 and FIG. 11 show a fourth embodiment. In FIG. 10, a small end columnar portion 13*b* of the support shaft 13 of the bearing element 12 integrated with the second inner tooth gear 11 shown in FIG. 3 penetrates through a plate element 18*a* having a through-hole 17. On the outer circumference of the small end columnar portion 13*b,* four plate springs 27 are pressed against the columnar portion 13*b* from the outer circumference.

In this embodiment, the four plate springs 27 are formed from a metal disk plate, or preferably a steel plate for a spring as shown in FIG. 10 and FIG. 11, and four notches 28 are punched out by a press and the like. By pressing the four plate springs 27 to the small end columnar portion 13*b* at equal intervals, a stable rotation suppression force is applied to the support shaft 13. The four plate springs 27 are preferably disposed at equal intervals of 90 degrees on the outer circumference of the small end columnar portion 13*b* of the support shaft 13. Similarly, the angle formed by the plate springs 27 is 180 degrees in the case of two springs, 120 degrees in the case of three springs, or 72 degrees in the case of five springs.

In this embodiment, by disposing a plurality of plate springs and pressing them to the support shaft from the outer circumference, the rotation suppressing force on the support shaft is stabilized.

Figure 12:
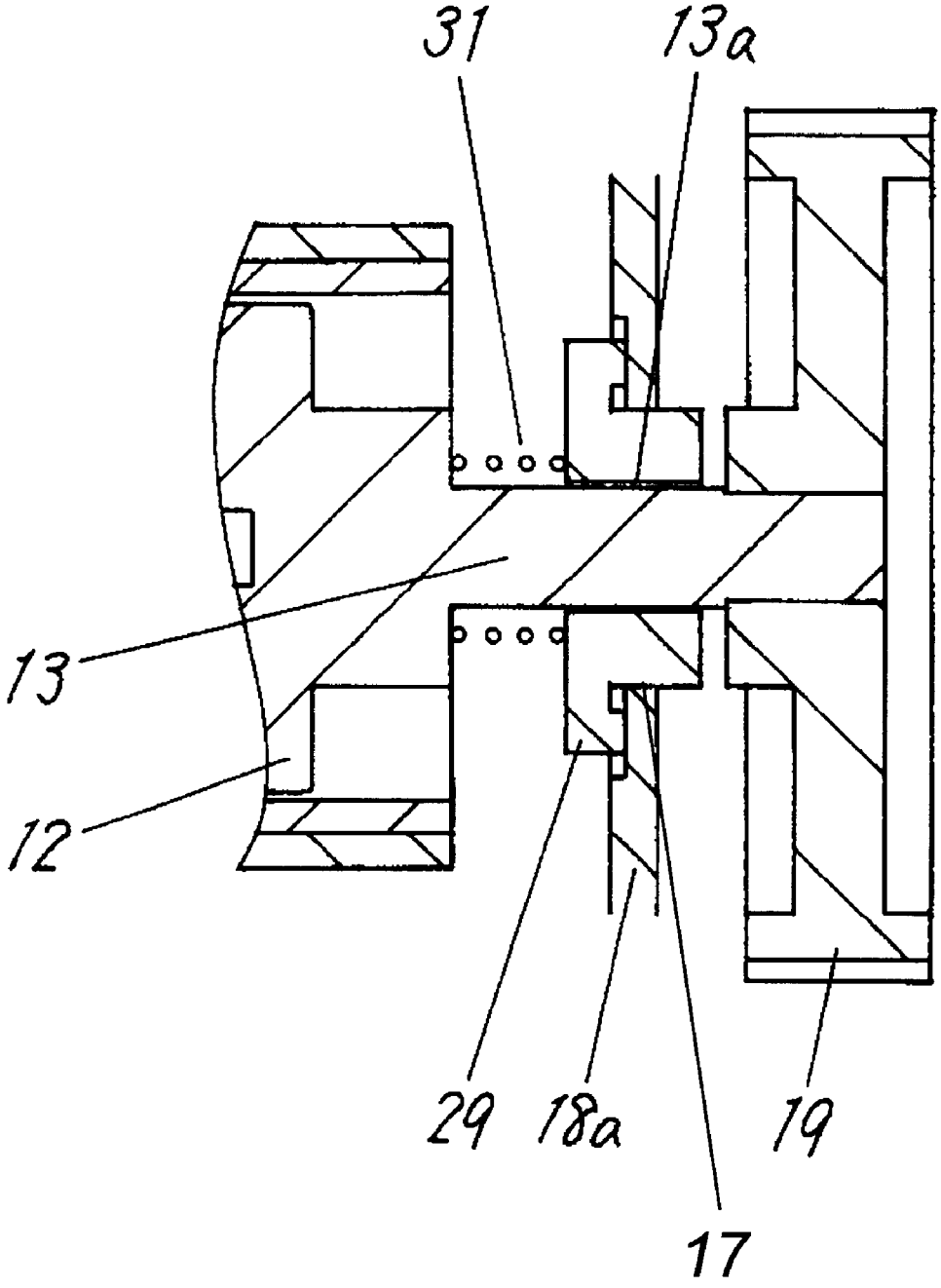
FIG. 12 is an essential sectional view of a fifth embodiment of the invention.
Figure 13:
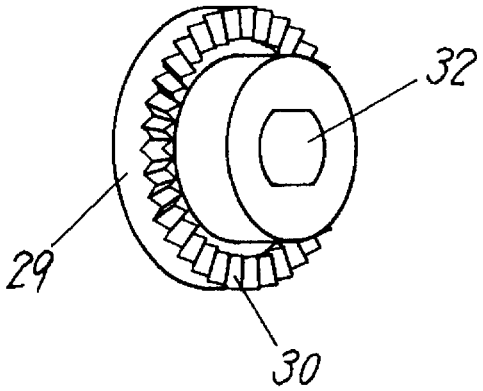
FIG. 13 is an essential perspective view of the fifth embodiment.

FIG. 12 and FIG. 13 show a fifth embodiment of the invention. In FIG. 12, a holding portion for the support shaft 13 of the bearing element 12 integrated with the second inner tooth gear 11 shown in FIG. 3 is formed by a plate member 18*a* having a through-hole 17, through which a flat portion 13*a* of the support shaft 13 penetrates.

Inside of the plate member 18*a,* a friction member 29 having an undulated surface 30 is provided. The flat portion 13*a* of the support shaft 13 penetrates a through-hole 32 of the friction member 29. In this state, the friction member 29 is pressed to the inner side of the plate member 18*a* by a spring 31. In this configuration, by adjusting the pressing force by the spring 31, the rotation suppressing force of the support shaft 13 (that is, the rotating force of the rotation knob 19) can be easily adjusted and varied.

In this embodiment, the through-hole 32 of the friction member 29 has a flat portion being the same as the flat portion 13*a* of the support shaft 13. It is formed slightly larger than the flat portion 13*a* so that the support shaft 13 may slide freely in the axial direction. Therefore, due to the pressing force of the spring 31, the undulated surface 30 can be securely pressed against the inner side of the plate member 18*a.* At least one plane portion is required in the support shaft 13 and through-hole 32 respectively, for preventing the support shaft 13 from slipping relative to the friction member 29 and thereby suppressing the rotation.

In the embodiment, by adjusting the pressing force by the spring, the rotation suppressing force of the support shaft can be varied easily.

Figure 14:
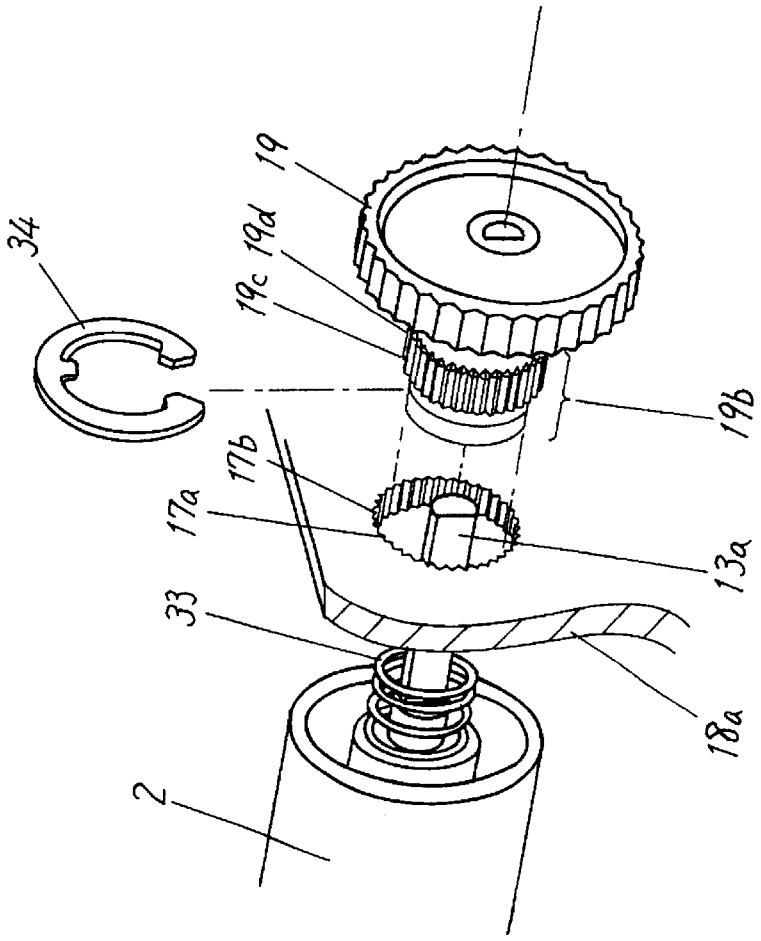
FIG. 14 is an essential perspective view of a sixth embodiment of the invention.
Figure 15:
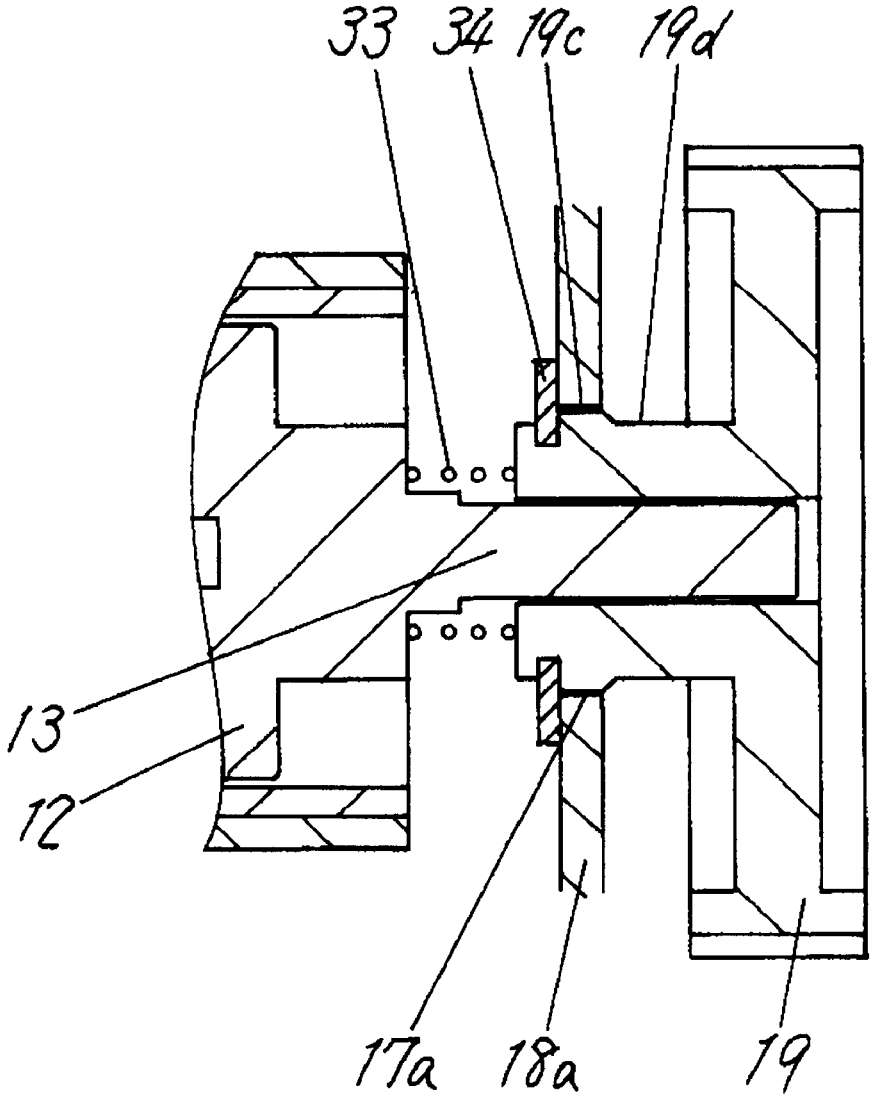
FIG. 15 is an essential sectional view of the sixth embodiment.
Figure 16:
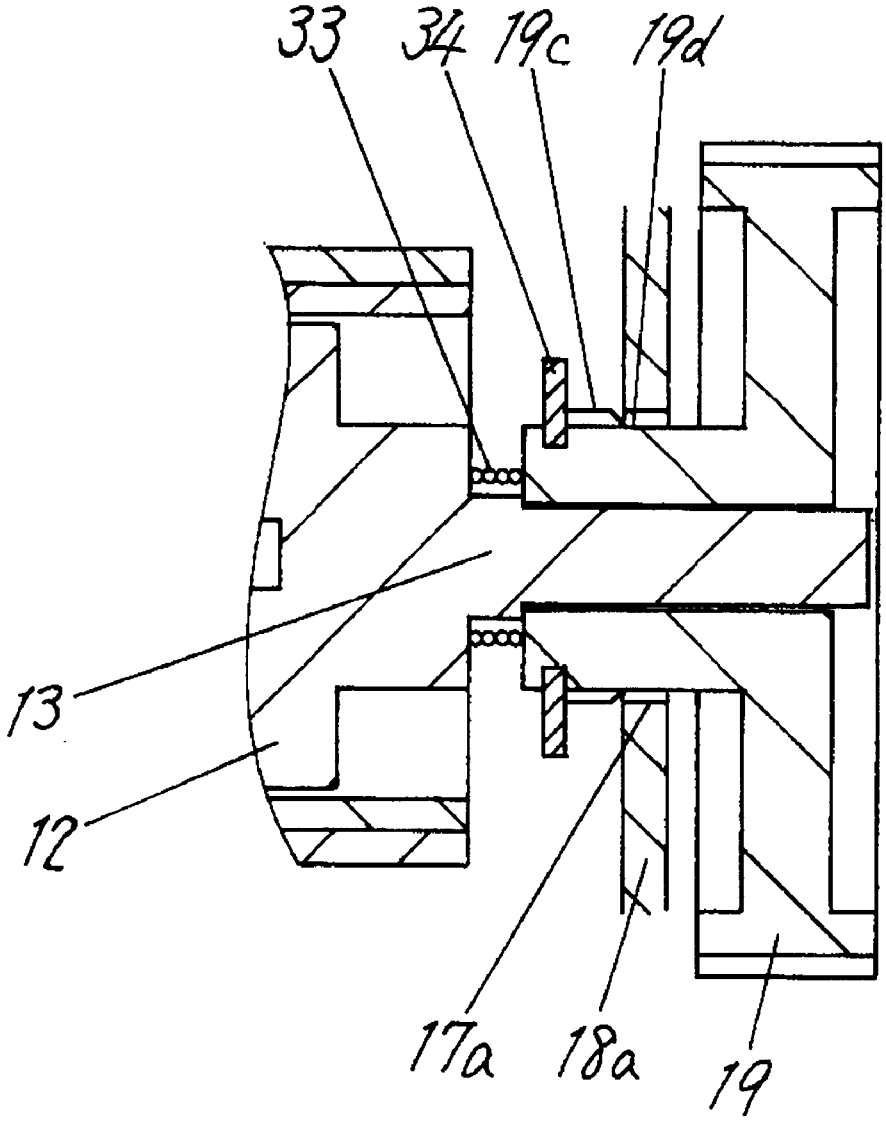
FIG. 16 is an essential sectional view of the sixth embodiment.

FIG. 14 to FIG. 16 show a sixth embodiment. In this embodiment, at the end of the cylindrical roller 2, a shaft portion 19*b* of a rotation knob 19 is fitted to the outer circumference of the support shaft 13 of the bearing element 12 at a flat end portion 13*a* thereof. This shaft portion 19*b* slidably penetrates a large-diameter through-hole 17*a* of a plate member 18*a*. This shaft portion 19*b* has a gear-like engaging portion 19*c* and a cylindrical sliding portion 19*d*. The engaging portion 19*c* engages a gear-like engaging portion 17*b* on an inner surface of the through-hole 17*a* of the plate member 18*a*. In this configuration, the shaft portion 9*b* of the rotation knob 19 is slidable on the flat portion 13*a* of the support shaft 13.

This portion is assembled as follows. First, as shown in FIG. 14, the shaft portion 19*b* penetrates from the outside of the plate member 18*a* to the inside of the through-hole 17*a*, and a spring 33 abuts against its end. A stopper ring 34 is fitted to the inner end side of the shaft portion 19*b* to prevent the knob 19 from slipping off. Thus, the rotation knob 19 is prevented from being slipping out of the support shaft 13. This state is shown in FIG. 15.

At this time, the engaging portion 19*c* of the shaft portion 19*b* is engaged with the engaging portion 17*b* of the through-hole 17*a*. Therefore, the rotation of the support shaft 13 is suppressed, so that the cylindrical roller 2 will not be rotated by the rotation knob 19 through the support shaft 13. To turn the cylindrical roller 2 by the rotation knob 19, as shown in FIG. 16, the rotation knob 19 is pressed while compressing the sprint 33 to the left in FIG. 16. As a result, the sliding portion 19*d* of the shaft portion 19*b* is pushed along shaft 13 until it is opposite to the engaging portion 17*b* of the through-hole 17*a*. In this state, the cylindrical roller 2 can be rotated by the rotation knob 19, and the printing sheet 21 is fed manually.

In this embodiment, by sliding the rotation knob and rotating, the cylindrical roller is turned, so that the printing sheet can be fed manually.

A seventh embodiment of the invention is explained by referring to FIG. 17 to FIG. 21. The same portions as in the prior art are identified with the same reference numerals, and a duplicate explanation is omitted.

Figure 17:
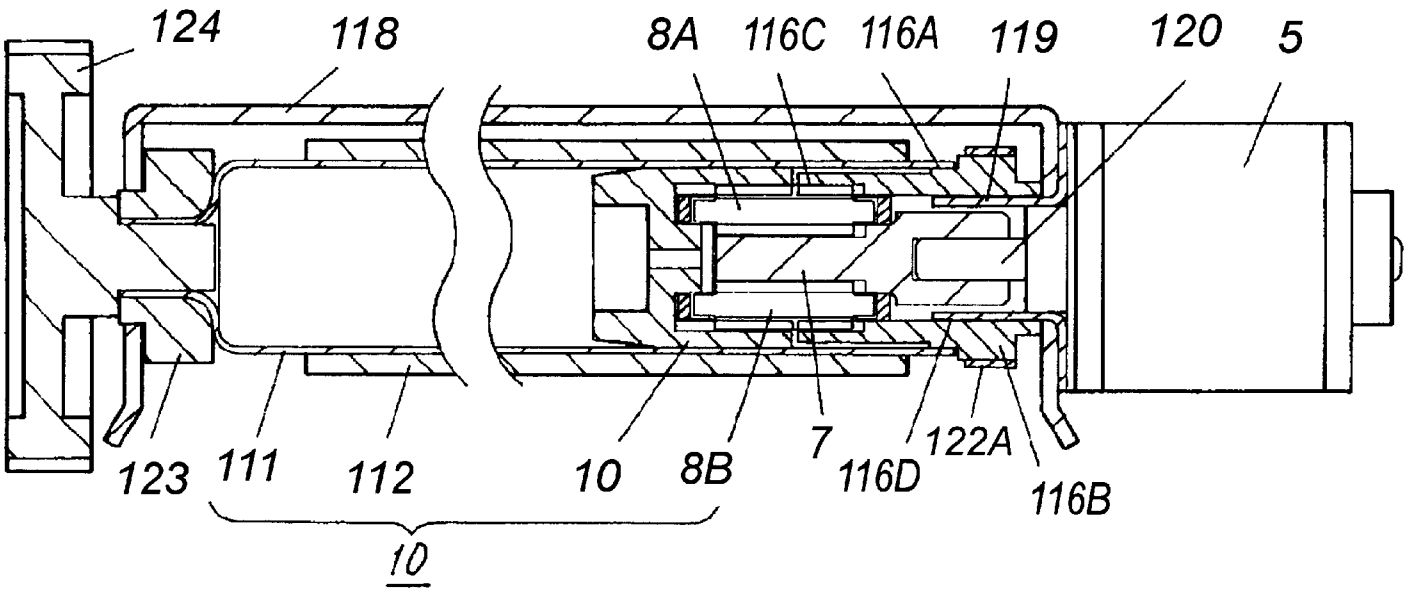
FIG. 17 is a sectional view of a cylindrical roller device in a seventh embodiment of the invention.
Figure 18:
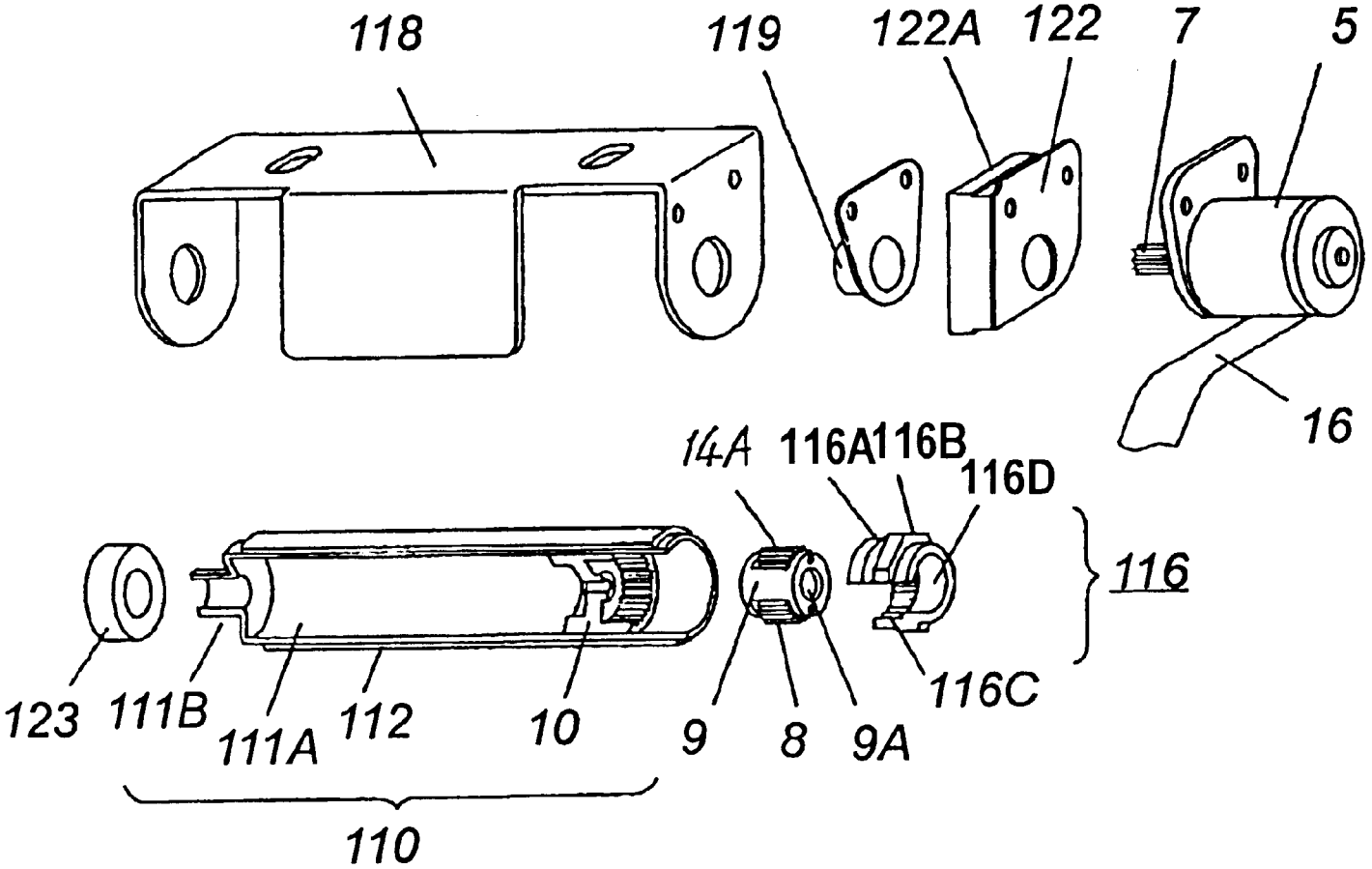
FIG. 18 perspective exploded view of the cylindrical roller device in the seventh embodiment.

FIG. 17 is a sectional view of a cylindrical roller device in the embodiment of the invention. FIG. 18 is its perspective exploded view.

As shown in these Figures, a cylindrical roller 110 is formed of a metal cylindrical pipe 111 of stainless steel or the like by a two-step deep drawing process. The outer circumference of a larger end 111A is covered with an elastic cylinder 112 such as silicone rubber, and a smaller end 111B is fitted to a bearing 123, and is rotatably supported on a frame 118.

Inside of the cylindrical roller 110, a first inner tooth gear 10 is formed, and the outer side of a planet gear 8 rotatably supported on a carrier 9 engages the first inner tooth gear 10. A bearing element 116 including a second inner tooth gear 116C is arranged coaxially with the first inner tooth gear 10. The bearing element 116 is formed of an oil-filled sinter by forming and baking fine metal particles and impregnating with synthetic oil or mineral oil. More specifically, the inner tooth gear 116 is shaped and arranged as follows. The outer circumference includes a protrusion 116A sliding on the inner circumference of the cylindrical roller 110, and a rotation suppressing portion 116B having a polygonal flat plane. The inner circumference has the second inner tooth gear 116C having a different number of teeth from that of the first inner tooth gear 10, and engaging the outer side of the planet gear 8 rotatably supported on the carrier 9.

The motor 5 is mounted on the frame 118 coaxially with the cylindrical roller 110, together with a cylindrical member 119. A sun gear 7 fixed on a rotary shaft 120 of the motor 5 is inserted into a central hole 9A of the carrier 8, and engages the inner sides of two planet gears 8A, 8B supported rotatably on the carrier 9 at a predetermined interval.

The operation of the sun gear, planet gears, and two inner tooth gears is the same as explained in the first embodiment.

One end of a controlling member 122 is fixed to the frame 118. An elastic member 122A at the other end presses the polygonal rotating suppressing portion 116B provided on the outer circumference of the bearing element gear 116 with a force greater than the driving force of the second inner tooth gear 116C. Thus, the rotation of the second inner tooth gear portion 116 is suppressed.

Further, a bearing portion 116D of the bearing element 116 is supported by the outer circumference of the cylindrical member 119 inserted into the frame 118.

An electronic apparatus including a printer using the roller device is explained below by referring to FIG. 19 to FIG. 21.

Figure 19:
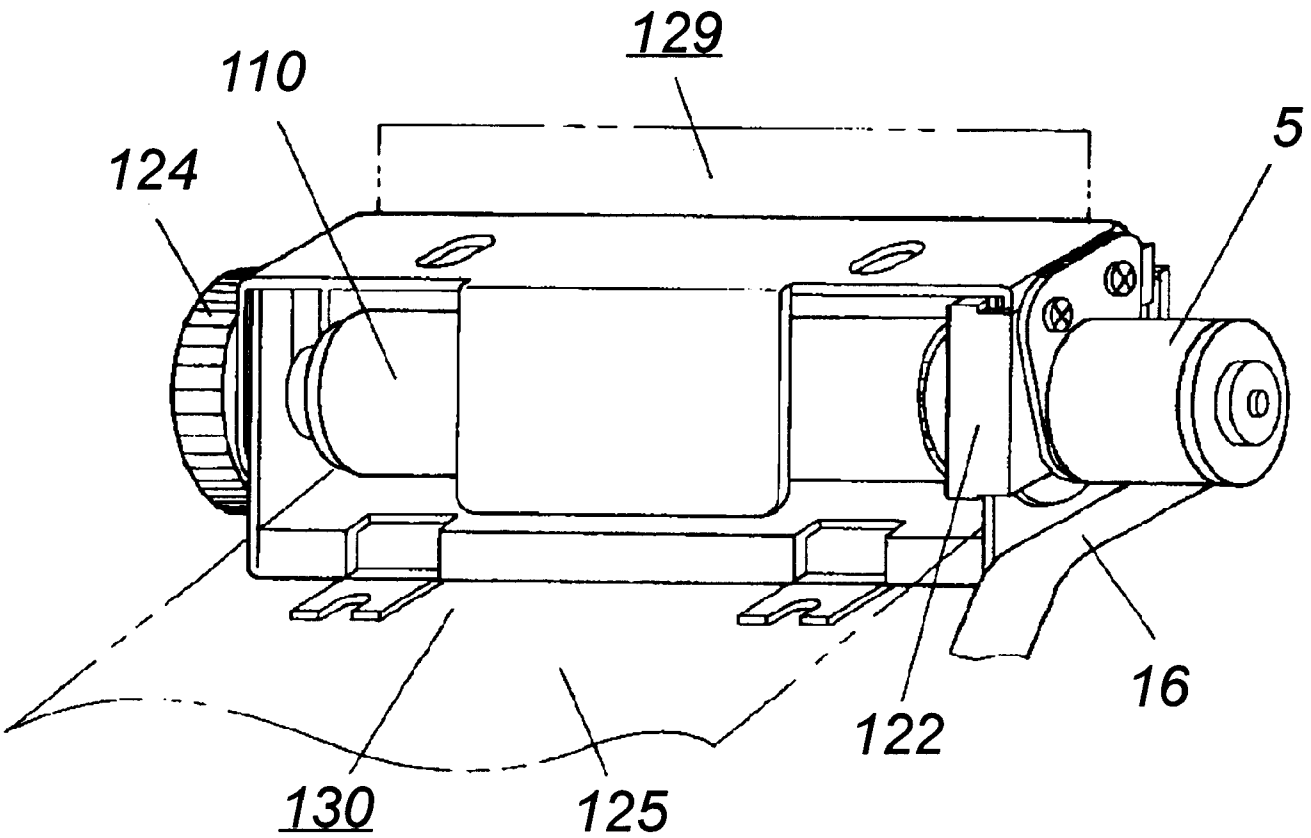
FIG. 19 is a perspective view of a printer in the seventh embodiment.
Figure 20:
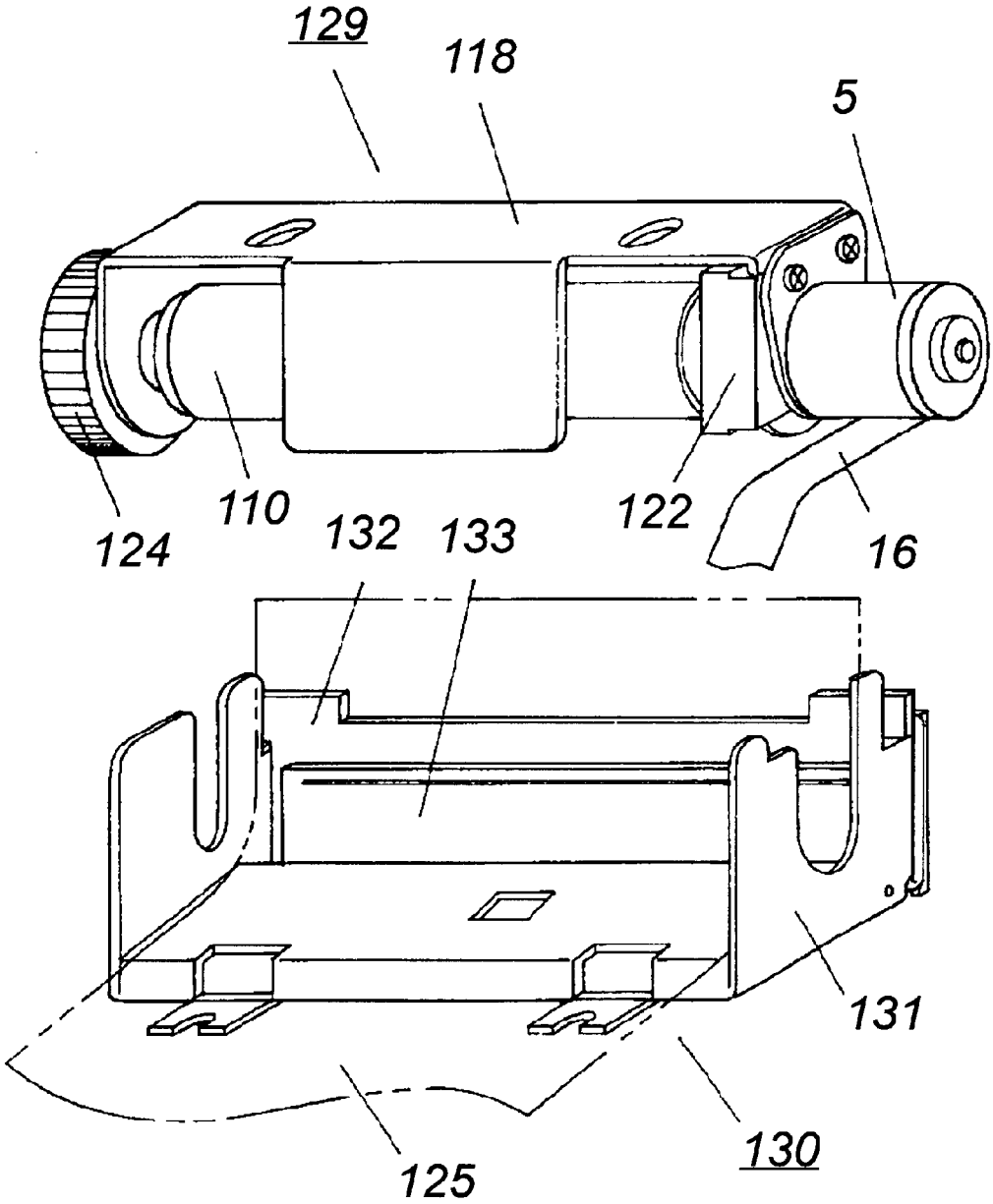
FIG. 20 is a perspective exploded view of the printer in the seventh embodiment.
Figure 21:
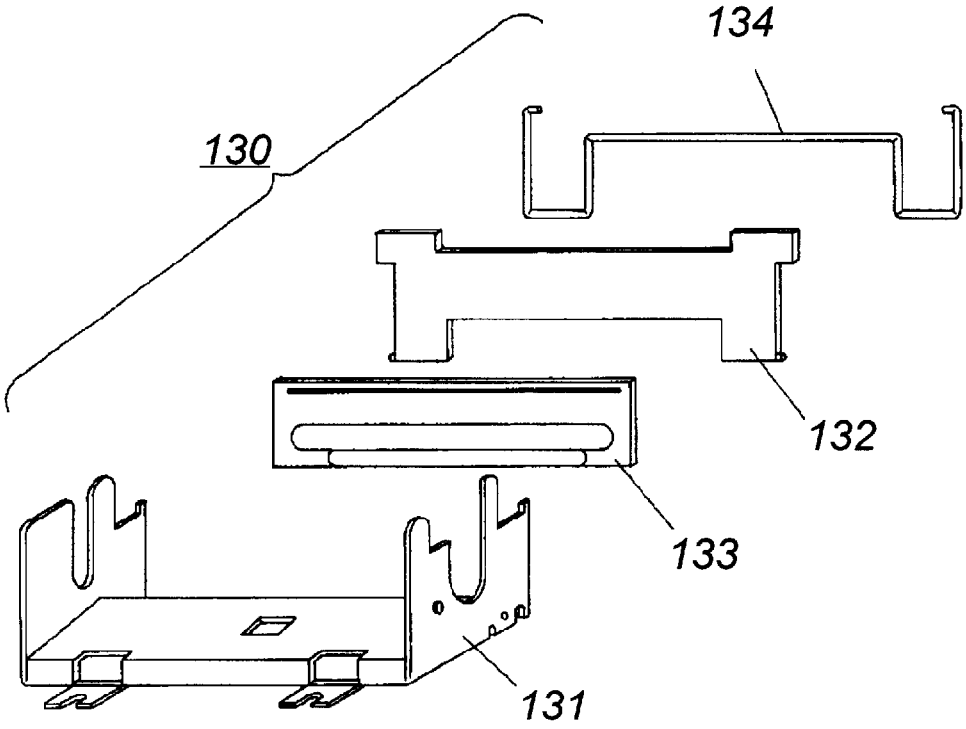
FIG. 21 is another perspective exploded view of the printer in the seventh embodiment.

FIG. 19 is a perspective view of a printer, FIG. 20 is its perspective exploded view, and FIG. 21 is a perspective exploded view of a frame unit of the printer. In these drawings, a roller device 129 and a frame unit 130 are combined to form a printer. The frame unit 130 includes a U-shaped base frame 131 having a bottom plate and side plates raised upward from both sides of the bottom plate, a mounting plate 132, a printing head 133, and a pressure spring 134 for pressing the printing head 133 against the cylindrical roller 110 through the mounting plate 132.

In this configuration, when the printing head 133 is pressed against the cylindrical roller 110 by the pressing spring 134, its force is received by the cylindrical member 119 fixed to the frame 118 through the protrusion 116A of the bearing element 116. Therefore, the pressing force is not applied to the sun gear 7 fixed to the shaft 120 of the motor 5, and the rotation of the motor 5 is transmitted appropriately to the planet gears 8A, 8B.

In the same way as in the first embodiment, when the motor 5 rotates, the planet gears 8A, 8B revolve, and a deviation occurs between the first inner tooth gear 10 and second inner tooth gear 116C based on the difference in the number of teeth.

The second inner tooth gear 116C has its rotation arrested by the rotation suppressing portion 116B pressed by the elastic member 122A of the controlling member 122. Therefore, in the same way as in the first embodiment, the cylindrical roller 110 having the first inner tooth gear 10 is decelerated and rotated.

This principle of operation is the same as explained with respect to the first embodiment. Due to the rotation of the cylindrical roller 110 to which the printing head 133 is pressed, a band of printing sheets 125 disposed between the cylindrical roller 110 and the printing head 133 is conveyed. At this time, when power is supplied to the printing head 133, characters and others are printed on the printing sheet 125, and the information is recorded. When the motor 5 is stopped, if the user attempts to feed the printing sheet 125, the user turns the rotation knob 124 provided on the cylindrical roller 110. This force is transmitted from the first inner tooth gear 10 to the planet gears 8. This force is further transmitted to the bearing portion 116D through the second inner tooth gear 116C. At this time, the rotation suppressing portion 116B receives a rotating force greater than a predetermined force from the controlling member 122. Thus, in the same way as in the first embodiment, the cylindrical roller 110 rotates step by step on each side of the polygon formed on the rotation suppressing portion 116B, so that the printing sheet 125 may be fed manually. Thus, according to the embodiment, the printer is reduced in size. Since the printer drive device is formed in a unit, it is easily assembled with the printer device main body.

If an external force greater than a predetermined rotating force is applied to the cylindrical roller 110, for example, by directly turning the cylindrical roller 110 manually, or by pulling out the printing sheet 125 disposed between the cylindrical roller 110 and the printing head 133 by force, destruction of the gearing mechanism can be avoided by properly rotating the second inner tooth gear 116C.

Further, by forming bearing element 116 from an oil-filled sinter, the lubrication of the sliding portions is increased, and the frictional load occurring between the bearing element 116 and cylindrical roller 110 can be reduced. This is because the oil-filled sinter is impregnated with synthetic oil or mineral oil after forming and sintering fine metal particles.

The inner periphery other than the inner tooth gear of the bearing element 116 (i.e., bearing portion 116D) is supported by the outer periphery of the cylindrical member 119 inserted in the frame 118. Thus, the pressure of the head 133 is received by the cylindrical member 119 through the cylindrical roller 110 and the second inner tooth gear 116. Therefore, deflection occurring in the fitting support portions of the cylindrical roller 110 and the bearing portion 116 is decreased, so that the cylindrical roller 110 and head 133 may uniformly contact each other.

Figure 22:
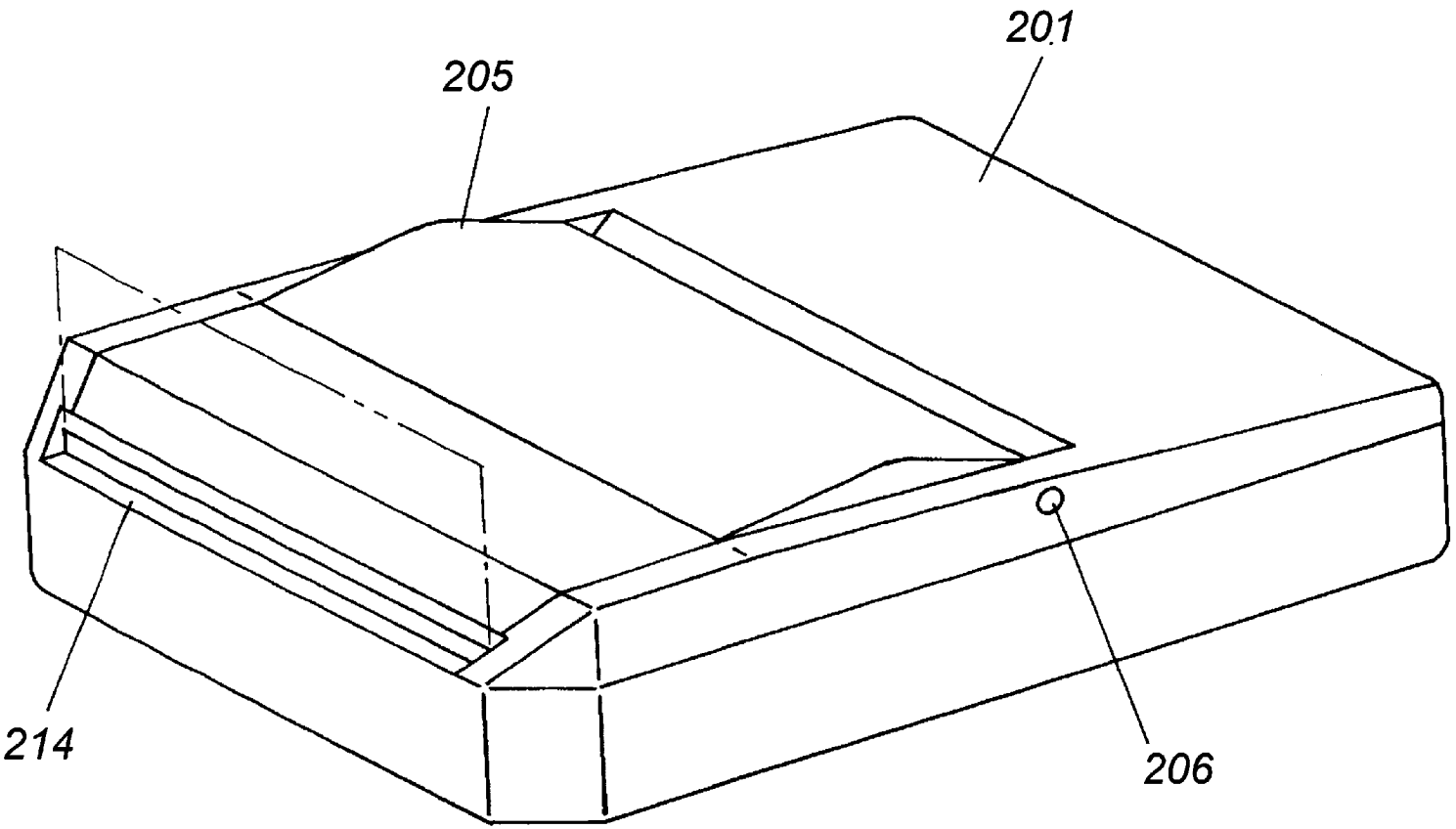
FIG. 22 is a perspective view of a printer in an eighth embodiment of the invention.
Figure 23:
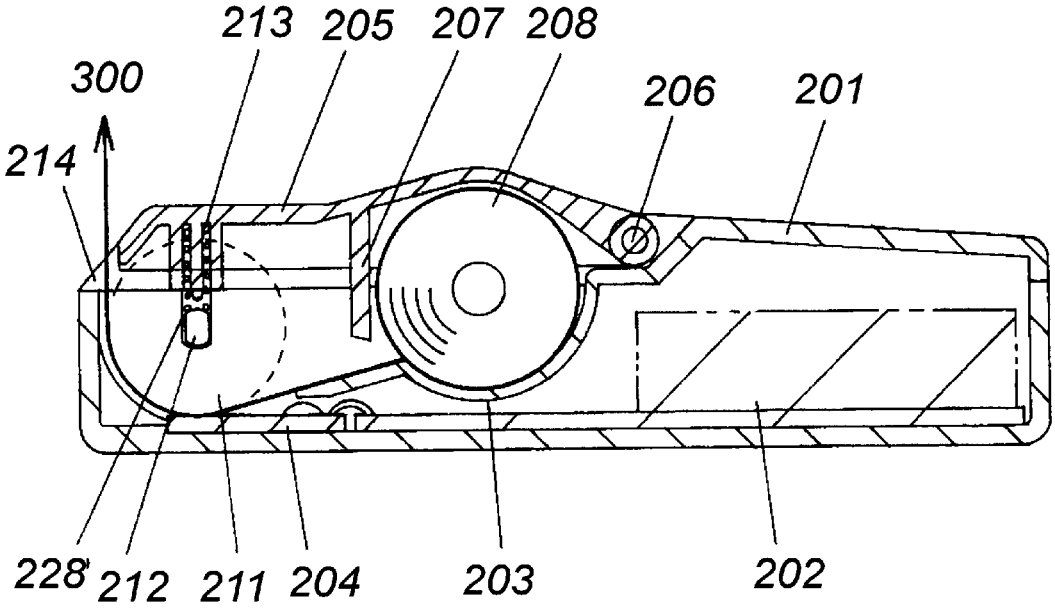
FIG. 23 is a sectional view of the printer in the eighth embodiment.
Figure 24:
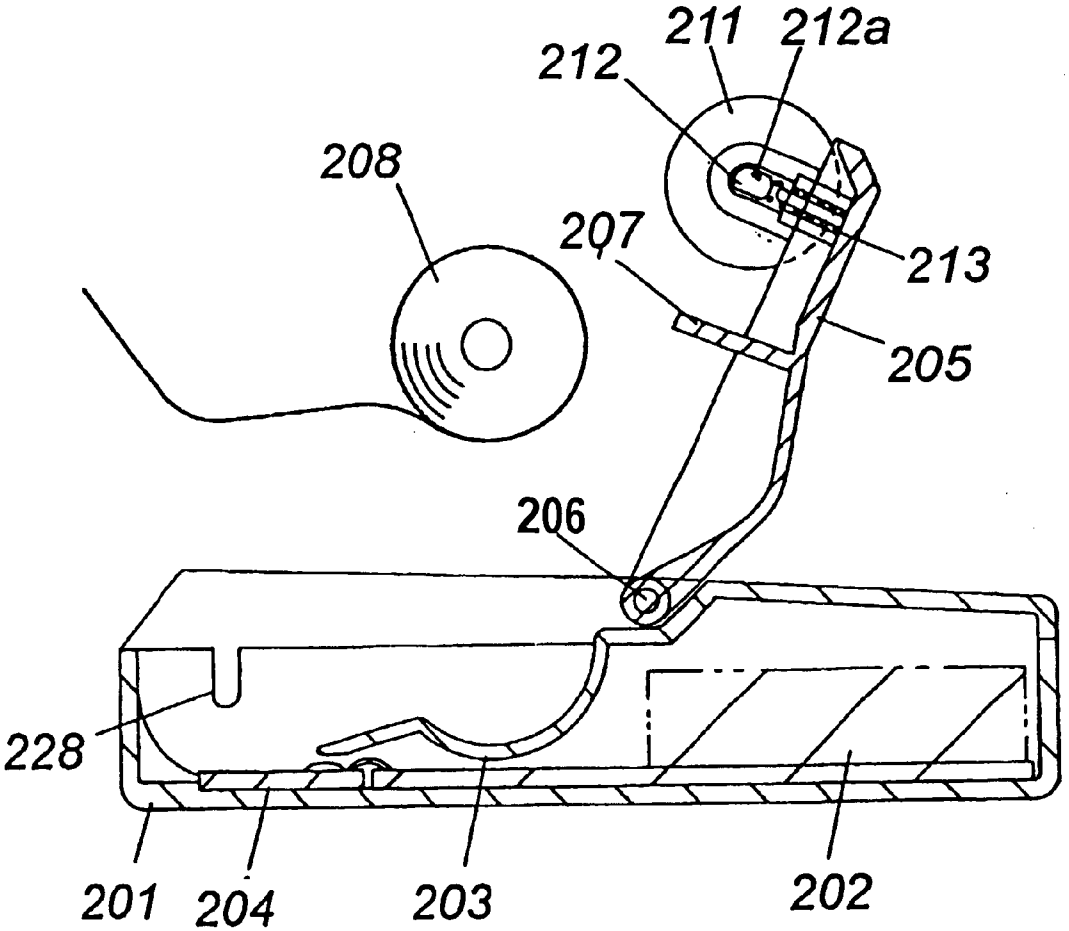
FIG. 24 is a sectional view with an open lid of the printer in the eighth embodiment.

The cylindrical roller 110 is composed of a two-step drawing pipe having a large diameter and a small diameter. By supporting the smaller diameter portion with the frame 118, the cylindrical roller 110 can be supported by the frame 118 without using different materials. Thus, according to the embodiment, a printer drive device of a small size is realized. In FIG. 22, in the inner rear portion of a main body case 201, a control unit 202 including a direct-current power source is accommodated as shown in FIG. 23 and FIG. 24. In the middle of the main body case 201, a concave accommodating portion 203 is provided. At the front side, of the main body case 201, there is a sheet receiver 204 having a head (generally called a thermal head) including a heating element on its top. On the front upper side of the main body case 201, a lid 205 is provided so as to be opened or closed freely by a shaft 206. In the lower middle portion of the lid 205, as shown in FIG. 23 and FIG. 24, a protruding wall 207 is extends downward. In the space formed between the protruding wall 207 and the accommodating portion 203, a roll of printing sheet 208 rotatably accommodated.

Figure 25:
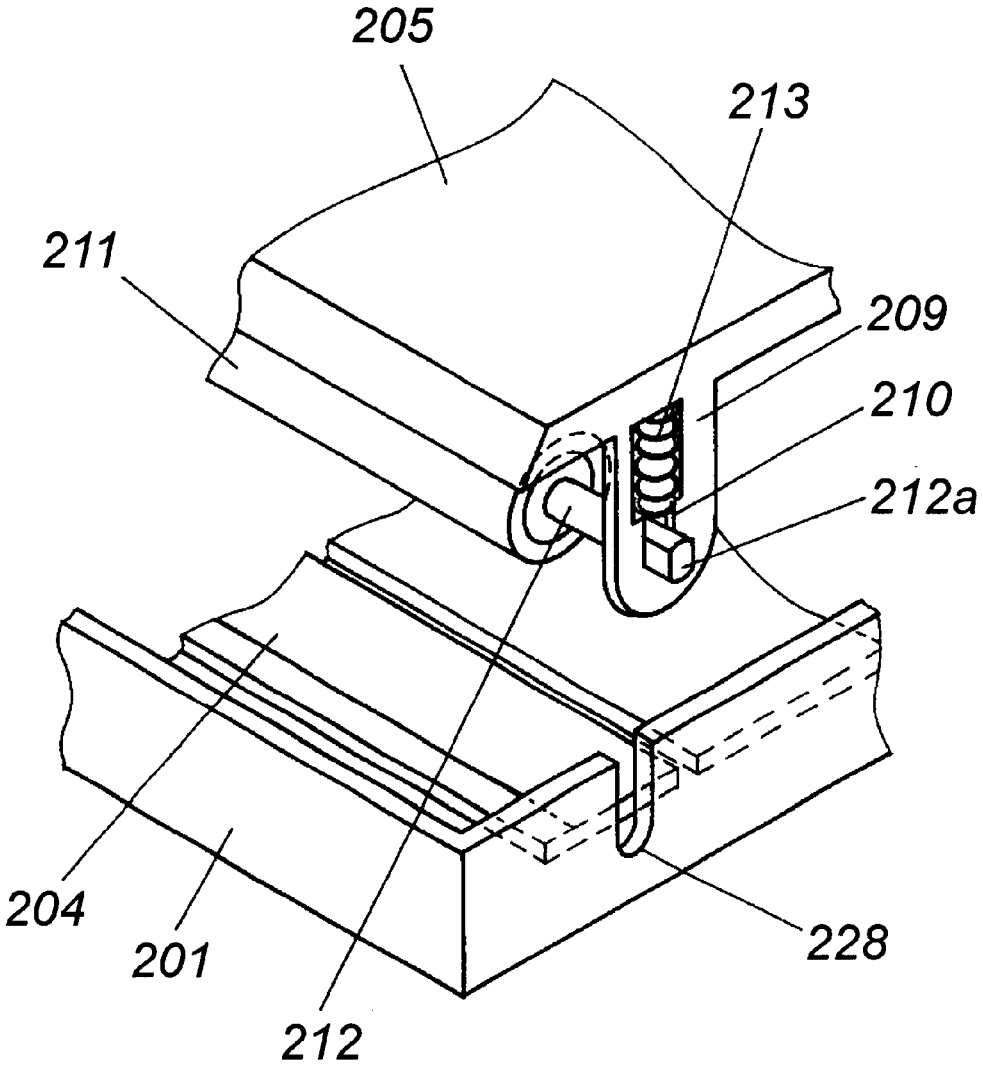
FIG. 25 is an essential sectional view with an open lid of the printer in the eighth embodiment.

On the other hand, at both sides in the lower front portion of the lid 205, a holding portion 209 is provided as shown in FIG. 25. A slit 210 is provided in this holding portion 209 in the vertical direction. In this slit 210, a flat portion 212*a* of a support shaft 212 provided at both ends of a cylindrical roller 211 is slidably fitted. This flat portion 212*a* is pressed downward by a spring 213. That is, the cylindrical roller 211 is always pressed downward by the spring 213. The lid 205, in the closed state as shown in FIG. 22 and FIG. 23, is fixed to the main body case 210 by an engaging portion not shown.

Thus, the printing sheet 208 is held between the sheet receiver 204 and cylindrical roller 211, and is conveyed forward by rotation of the cylindrical roller 211. At this time, the printing sheet 208 is printed by the head of the sheet receiver 204. It is then discharged from a front discharge port 214 of the main body case 201 as shown in FIG. 22 and FIG. 23.

The cylindrical roller 211 is the same as the roller device in the first embodiment in its structure and operation. The support shafts 212 projecting at both sides of the cylindrical roller 211 correspond to support shaft 13 and extended portion 149 of support element 14 as shown in FIG. 3. The support shafts 212 are slidably fitted and held in the slit 210 of the holding portion 209 of the lid 205.

As illustrated in FIG. 3 and FIG. 4, when power is supplied to the motor 5 through the power feed line 16, the sun gear 7 rotates, the planet gears 8 revolve, and a deviation occurs between the first inner tooth gear 10 and the second inner tooth gear 11. At this time, the second inner tooth gear 11 has its rotation arrested, as its bearing element 12 fits between the flat portion 13*a* of the support shaft 13 and the slit 210 of the holding portion 209. Therefore, in the same way as in the first embodiment, the cylindrical roller 211 including the first inner tooth gear 10 is decelerated and rotated. Due to the rotation of the cylindrical roller 211, as shown in FIG. 23, a band of printing sheets 8 conveyed in the direction of an arrow 300.

This operation is the same as in the first embodiment. The thermal head on the top of the sheet receiver 204 is disposed, as mentioned above, on the surface confronting the cylindrical roller 211 opposite to the band of printing sheet 208. When thermal paper is used as the printing sheet 208, power is supplied to the thermal head as the printing sheet 208 is fed, and information is recorded on the printing sheet 208.

By recording information on the printing sheet 208, when the printing sheet 208 is consumed, as shown in FIG. 24, engagement with the main body case 201 formed on the lid 205 is cleared. Further, the lid 205 is opened, and a new roll of printing sheet 208 is loaded. Thus, the printing sheet is changed smoothly. The lid 205 is closed again as shown in FIG. 23, and the information is recorded.

When changing the printing sheet 208, a clearance is kept between the cylindrical roller 211 and sheet receiver 204. After setting the printing sheet 208, the cylindrical roller 211 is pressed to the sheet receiver 204 side by the spring 213. Thus, the printing sheet 208 is held between the cylindrical roller 211 and sheet receiver 204.

Thus, due to the contacting and departing operation with and from the printing sheet 208, the relation between the cylindrical roller 211 and driving element is constant. Therefore, the cylindrical roller 211 operates securely. This is because the driving elements of the cylindrical roller 211, such as the motor 5, the sun gear 7, and the planet gears 8 are disposed within the cylindrical roller 211.

As shown in FIG. 25, meanwhile, a guide groove 228 guides the flat portion 13*a* (212*a*) of the support shaft 13 (212) when closing the lid 205. Therefore, the cylindrical roller 211 descends on the thermal head on the sheet receiver 204 in an adequate state.

Figure 26:
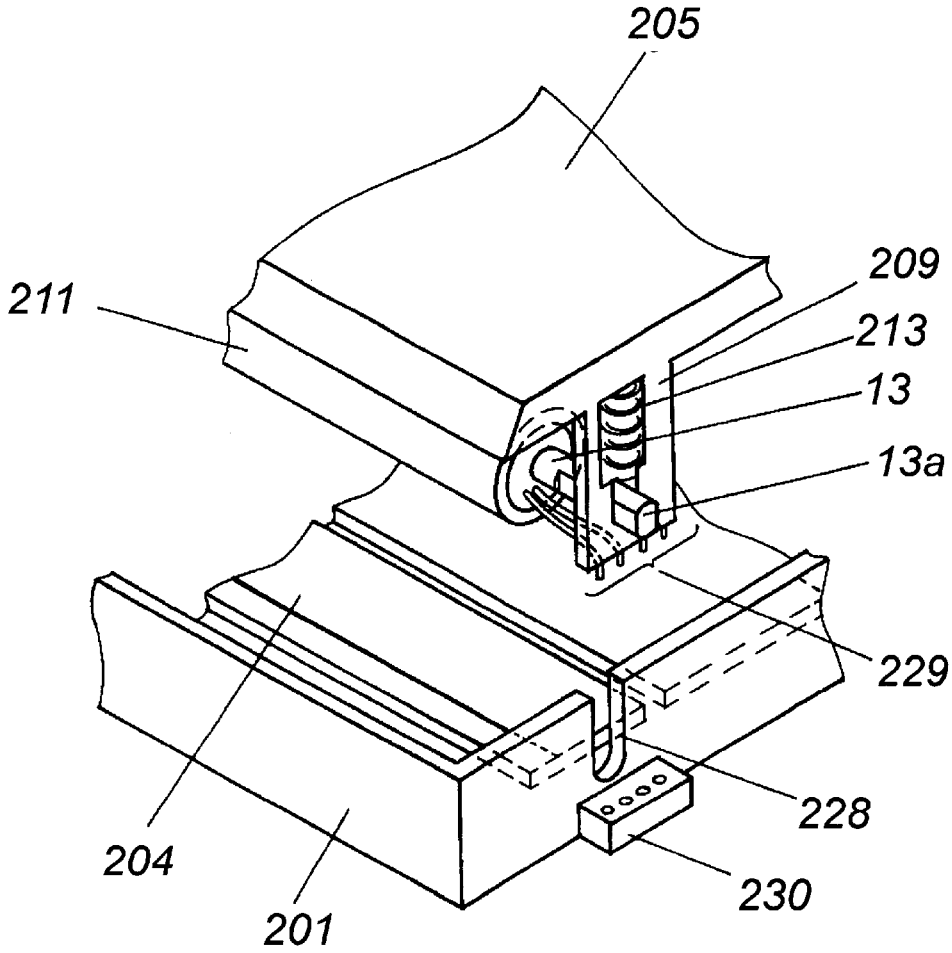
FIG. 26 is an essential perspective view of a printer in a ninth embodiment of the invention.

FIG. 26 shows a ninth embodiment of the invention. A terminal 229 connected to the driving element (motor 5) of the cylindrical roller 211 is provided in a holding portion 209 provided in the lid 205. Further, in the main body case 201 portion opposite to this terminal 229 when closing the lid 205, a plug socket 230 to be fitted to the terminal 229 is provided. In this embodiment, based on the opening and closing of the lid 205, the power feed route to the driving element is opened or closed, so that a printer of a very high convenience is presented.

Figure 27:
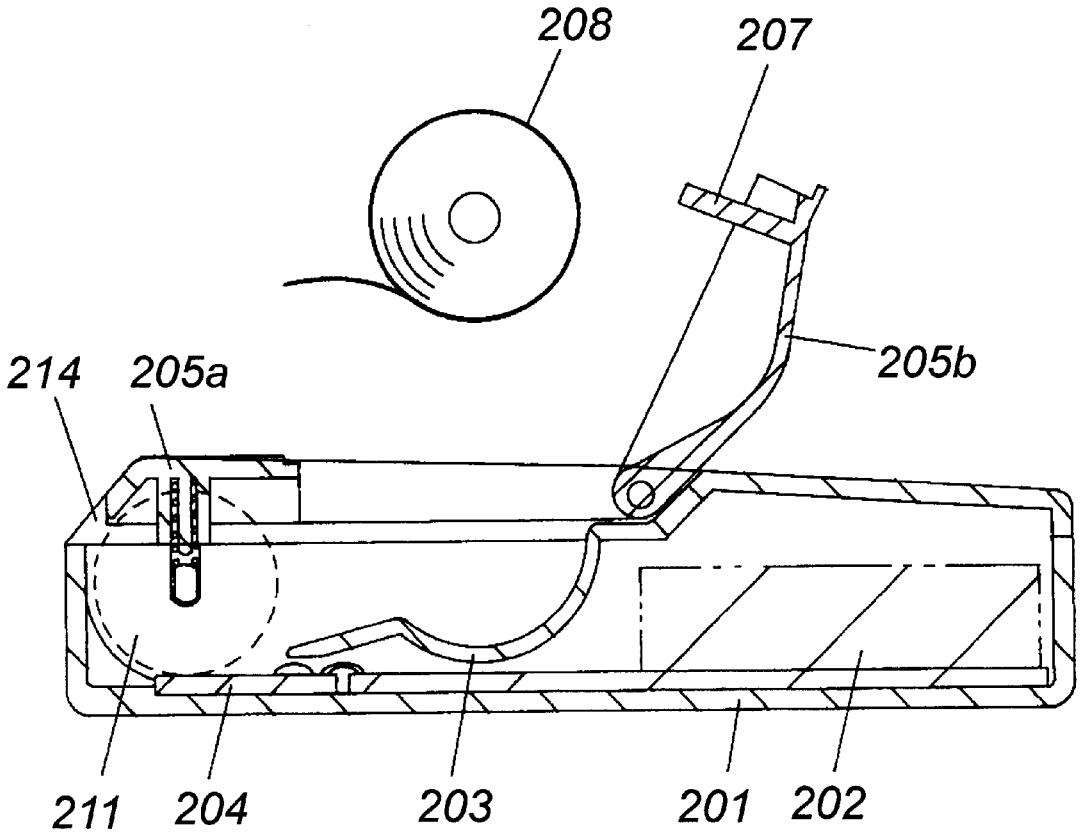
FIG. 27 is a sectional view with an open lid of the printer in the ninth embodiment.

FIG. 27 shows a tenth embodiment of the invention. The lid 205 is divided into two portions, and the front portion 205*a* is normally closed as shown in FIG. 27. When changing the printing sheet 208, only the rear portion 205*b* is opened. Thus, the leading end of the printing sheet 208 is inserted between the cylindrical roller 211 and sheet receiver 204, and the motor 217 operates in this state. Thus, the printing sheet 208 is conveyed to the discharge port 214 side. When this setting is over, the rear portion 205*b* of the lid 205 is also closed.

In the eighth to tenth embodiments, since the driving elements of the cylindrical roller 211 are provided within this cylindrical roller, the relation between the cylindrical roller and the driving elements is constant. Hence, the roller operates securely.

An eleventh embodiment, a driving device is provided in a cylindrical roller, and forms a unit together with a frame having a printing head. Therefore, the cylindrical roller is compact, and can be installed in various electronic apparatuses to be used as information recording element.

Figure 28:
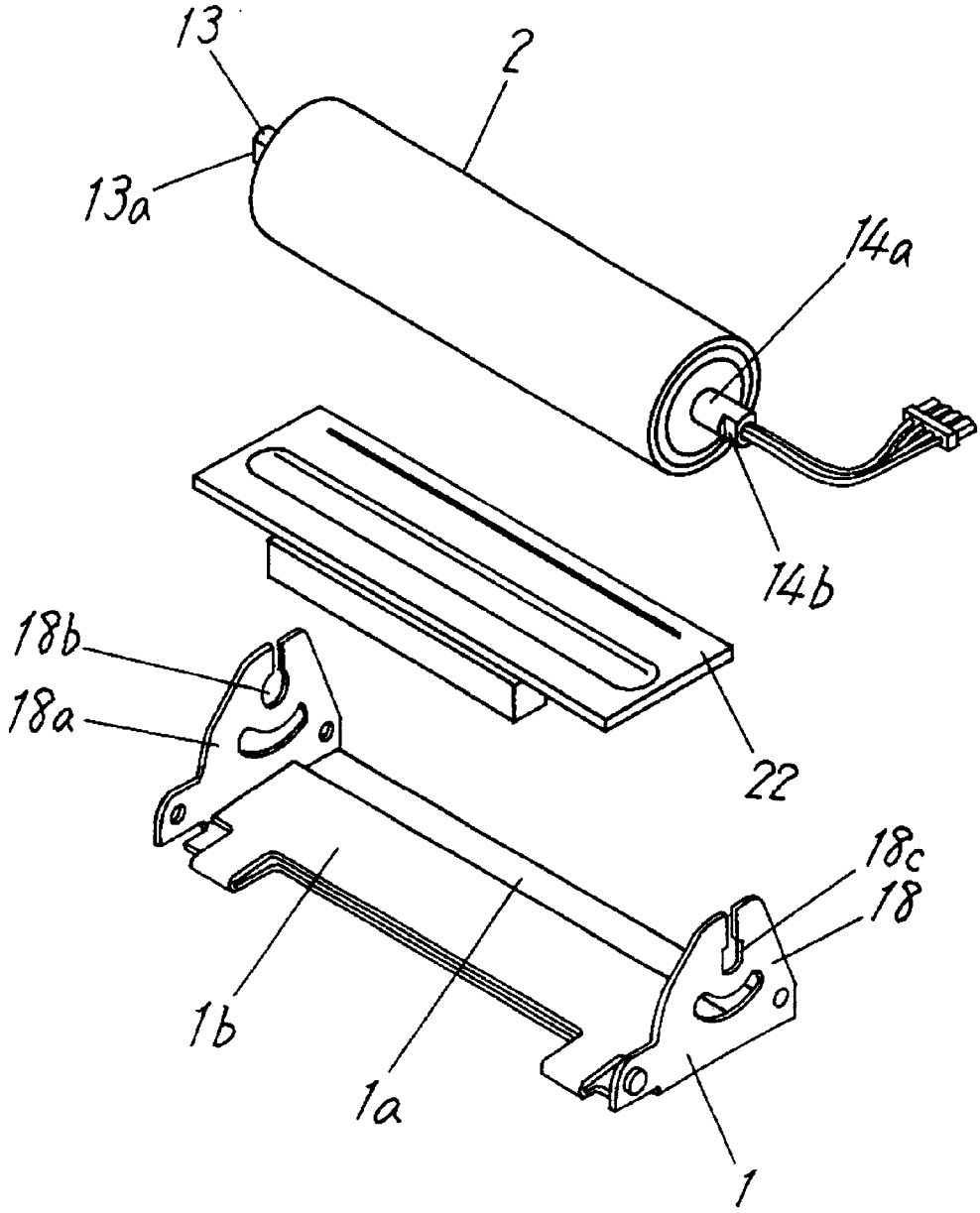
FIG. 28 perspective exploded view of a cylindrical roller device in a tenth embodiment of the invention.

This embodiment is explained below while referring to FIG. 1, FIG. 2, FIG. 6, and FIG. 28. In FIG. 28, a cylindrical roller 2 is disposed on a U-shaped frame 1 made of metal plate. The cylindrical roller 2 is the same as the roller device in the first embodiment in both structure and operation. The frame 1 includes, as shown in FIG. 28, a bottom plate 1*a*. and plate members 18. 18*a* extended upward from both sides. A mounting plate 1*b* is bent and raised from the bottom plate 1*a*. Therefore, the mounting plate 1*b* is elastic. Further, a thermal head 22 is fixed on the mounting plate 1*b*. A support shaft 13 of the cylindrical roller 2 penetrates a circular through-hole 18*b* of the plate member 18*a,* and is rotatable supported in this through-hole 18*b*.

A support shaft 14*a* of the cylindrical roller 2 penetrates a through-hole 18*c* of the plate element 18, and its flat portion 14*b* is fitted in this through-hole 18*c,* so as to be supported to stop the rotation. Further, on the outer circumference of the flat portion 13*a* of the support shaft 13, as shown in FIG. 2, a rotation suppressor 19*a* formed integrally on a rotation knob 19 made of synthetic resin is provided. This rotation suppressor 19*a* has a polygonal outer circumference (specifically, an octagonal shape) as shown in FIG. 6. A free end of a plate spring 20 is pressed against an outer circumference of rotation suppressor 19*a,* so that the rotation is suppressed.

The opposite side of the free end of the plate spring 20 is fixed to the plate member 18*a* by of a screw 20*a*.

In this state, when the motor 5 rotates, as explained in FIG. 3 and FIG. 4 relating to the first embodiment, the sun gear 7 rotates, and the planet gears 8 revolve. As a result, a deviation occurs between the first inner tooth gear 10 and second inner tooth gear 11. At this time, since the second inner tooth gear 11 provided on the bearing has its rotation arrested by the rotation suppressor 19*a,* as mentioned above, the first inner tooth gear 10 on the cylinder 3 is decelerated and rotated together with the cylinder 4. Due to the rotation of the cylinders 3, 4 (that is due to the rotation of the cylindrical roller 2) the band of printing sheet 21 is conveyed in the direction of arrow 300 as shown in FIG. 2.

This operation is the same as in the first embodiment. In other words, the cylindrical roller 2 and thermal head 22 are pressed because the mounting plate 1*b* is elastic as mentioned above. Hence, by rotation of the cylindrical roller 2, the printing sheet 21 is conveyed. When the printing sheet 21 is a thermal paper, by feeding power to the thermal head 22, the information is recorded.

At the end of the information recording (that is, when no power is supplied to the motor 5, in the case in which the printing sheet 21 is to be fed in the direction of arrow 300 in FIG. 1) the rotation knob 19 is turned in the direction of an arrow 301 in FIG. 2.

At this time, due to the pressing force of the plate spring 20 to the rotation suppressor 19*a,* a rotating force greater than a predetermined force is applied. This rotating force is transmitted to the bearing element 12, the second inner tooth gear 11, the planet gears 8 coupled to the second inner tooth gear 11, and the first inner tooth gear 10. Consequently, the cylindrical roller 2 rotates step by step on each side of the polygon formed on the rotation suppressor 19*a*. As a result, the printing sheet 21 is fed manually in the direction of arrow 300 in FIG. 2.

Thus, in this embodiment, forming the driving device in the cylindrical roller, a unit is formed together with the frame having the printing head. Therefore, this roller device is compact, and when installed in various electronic apparatuses, it can be used as information recording element. Further, the elastic element on the bottom plate of the frame may press the thermal head to the cylindrical roller, so that the printing sheet can be conveyed smoothly. The mounting plate is also formed integrally with the frame, so that the structure may be simplified.

In the same manner as in other embodiments, by decelerating the motor rotating speed by the sun gear and planet gears, the cylindrical roller can be rotated appropriately.

INDUSTRIAL APPLICABILITY

According to the invention, when manually turning the cylindrical roller used in a printer or the like, damage to planet gears and the first and second inner tooth gears can be prevented. Therefore, the printing sheet can be fed manually by turning the cylindrical roller manually. Also according to the invention, a printer and other electronic apparatuses capable of operating the roller securely can be obtained. Further according to the invention, a printer of a compact design is obtained.

What is claimed is:

1. A roller device comprising:

a cylindrical roller having an inner circumference and a first inner tooth gear on said inner circumference;

a motor including a motor shaft accommodated at a first end of said cylindrical roller, and including a fixing portion at a second end of said cylindrical roller;

a sun gear coupled with said motor shaft in said cylindrical roller;

a bearing element having a second inner tooth gear and having a support shaft disposed in said cylindrical roller, said bearing element being arranged such that a rotation of said second inner tooth gear is controlled by a predetermined force;

a planet gear in said cylindrical roller and engaging said sun gear, engaging said first inner tooth gear, and engaging said second tooth gear; and a bearing mechanism for supporting said cylindrical roller rotatably on said bearing element.

2. The roller device of claim 1, wherein said support shaft of said bearing element is disposed at said second end of said cylindrical roller, further comprising a holding portion for elastically pressing and holding said support shaft of said bearing element.

3. The roller device of claim 2, further comprising a rotation knob at an end of said support shaft of said bearing element.

4. The roller device of claim 3, wherein said holding portion comprises a plate member having a through-hole, said support shaft of said bearing element extending through said through-hole, further comprising an elastic member pressed to said support shaft of said bearing element so as to be arranged at at least one of an inner side and an outer side of said plate member.

5. The roller device of claim 3, wherein said holding portion comprises a plate member having a through-hole, further comprising a bushing fitted into said through-hole of said plate member, said support shaft of said bearing element extending through a through-hole of said bushing by elastically deforming said bushing.

6. The roller device of claim 3, wherein said holding portion comprises a plate member having a through-hole, said support shaft of said bearing element extending through said through-hole, further comprising a friction member on said support shaft at at least one of an inner side and an outer side of said plate member, and further comprising a spring for pressing said friction member against said plate member.

7. The roller device of claim 2, wherein said holding portion comprises a plate member having a through-hole, said support shaft of said bearing element extending through said through-hole, further comprising an elastic member pressing against said support shaft of said bearing element and arranged at at least one of an inner side and an outer side of said plate member.

8. The roller device of claim 7, further comprising a rotation suppressor on an outer circumference of said support shaft of said bearing element, an outer circumference of said rotation suppressor having a polygonal shape, said elastic member comprising a plate spring pressing against said outer circumference of said rotation suppressor.

9. The roller device of claim 7, wherein said elastic member comprises a plate spring, further comprising a friction member arranged between said plate spring and said support shaft such that said plate spring presses against said support shaft via said friction member.

10. The roller device of claim 7, wherein said elastic member comprises a plurality of plate springs for pressing against said support shaft.

11. The roller device of claim 2, wherein said holding portion comprises a plate member having a through-hole, further comprising a bushing fitted into said through-hole of said plate member, said support shaft of said bearing element extending through a through-hole of said bushing by elastically deforming said bushing.

12. The roller device of claim 2, wherein said holding portion comprises a plate member having a through-hole, said support shaft of said bearing element extending through said through-hole, further comprising a friction member on said support shaft at at least one of an inner side and an outer side of said plate member, and further comprising a spring for pressing said friction member against said plate member.

13. The roller device of claim 1, further comprising a plate member and a rotation knob having a shaft portion fitted to an outer circumference of an end of said support shaft of said bearing element at a second end of said cylindrical roller, said shaft portion of said rotation knob slidably penetrating a through-hole of said plate member, said shaft portion of said rotation knob having an engaging portion and a sliding portion, said rotation knob being operable to slide on said support shaft of said bearing element such that said engaging portion engages an inner surface of said through-hole of said plate member.

14. The roller device of claim 1, wherein said first inner tooth gear and said second inner tooth gear have a different number of teeth.

15. The roller device of claim 14, further comprising a frame for rotatably supporting at least one of said first end and said second end of said cylindrical roller, said motor being fixed coaxially with respect to said cylindrical roller.

16. The roller device of claim 14, further comprising an elastic member for controlling a rotation of said second inner tooth gear of said bearing element by pressing said support shaft of said bearing element with a force greater than a driving force of said first inner tooth gear.

17. The roller device of claim 14, further comprising a frame for rotatably supporting at least one of said first end and said second end of said cylindrical roller, and further comprising a cylindrical member extending through said frame, said bearing element having a bearing portion adjacent to said second inner tooth gear, an outer circumference of said cylindrical member being inserted into said bearing portion of said bearing element so as to support said bearing element.

18. The roller device of claim 14, further comprising a frame for rotatably supporting at least one of said first end and said second end of said cylindrical roller, said cylindrical roller comprising a drawing pipe having a large-diameter end portion and a small-diameter end portion, said small-diameter end portion being supported by said frame.

19. The roller device of claim 1, wherein said second inner tooth gear is formed of an oil-filled sinter.

20. An electronic apparatus comprising:

a main body case including an accommodating portion for accommodating a printing sheet therein, including a plug socket, and including a lid facing said accommodating portion, said lid having a holding portion;

a sheet receiver in said main body case;

a head for recording information on a printing sheet in said main body case; and a roller for holding the printing sheet against said sheet receiver, said roller including:

a cylindrical roller having a first end and a second end;

a driving element in said cylindrical roller, said driving element including a terminal in said holding portion of said lid, said terminal being shaped and arranged so as to be fitted to said plug socket of said main body case when said lid is in a closed position;

a support element projecting from said first end of said cylindrical roller;

a support shaft projecting from said second end of said cylindrical roller; and a bearing mechanism at each of said first end and said second end of said cylindrical roller for supporting each of said support element and said support shaft;

wherein each of said support element and said support shaft is held by said holding portion of said lid such that said cylindrical roller is operable to move relative to said sheet receiver.

21. The electronic apparatus of claim 20, wherein said holding portion includes a pressing element for pressing each of said support element and said support shaft such that said cylindrical roller is pressed against said sheet receiver.

22. The electronic apparatus of claim 20, wherein said head is positioned on a surface of said sheet receiver, said head including a heating element, said cylindrical roller of said roller being arranged to hold the printing sheet against said head.

23. The electronic apparatus of claim 20, wherein said holding portion has a slit, said support shaft having a flat portion slidably fitted in said slit.

24. The electronic apparatus of claim 20, wherein said driving element comprises a motor having a motor shaft, said roller further including:

a sun gear on said motor shaft of said motor in said cylindrical roller;

a planet gear engaging said sun gear in said cylindrical roller;

a first inner tooth gear on an inner circumference of said cylindrical roller and facing said planet gear; and a bearing element having a second inner tooth gear engaging said planet gear, and having said support shaft projecting from a side thereof opposite said motor.

25. An electronic apparatus comprising:

a main body case including an accommodating portion for accommodating a printing sheet therein, and including a lid facing said accommodating portion, said lid having a holding portion with a slit;

a sheet receiver in said main body case;

a head for recording information on a printing sheet in said main body case; and a roller for holding the printing sheet against said sheet receiver, said roller including:

a cylindrical roller having a first end and a second end;

a driving element in said cylindrical roller;

a support element projecting from said first end of said cylindrical roller;

a support shaft projecting from said second end of said cylindrical roller; and a bearing mechanism at each of said first end and said second end of said cylindrical roller for supporting each of said support element and said support shaft;

wherein said support shaft has a flat portion slidably fitted in said slit of said holding portion, said support shaft and said support element being held by said holding portion such that said cylindrical roller is operable to move relative to said sheet receiver.

26. An electronic apparatus comprising:

a main body case including an accommodating portion for accommodating a printing sheet therein, and including a lid facing said accommodating portion, said lid having a holding portion;

a sheet receiver in said main body case;

a head for recording information on a printing sheet in said main body case; and a roller for holding the printing sheet against said sheet receiver, said roller including:

a cylindrical roller having a first end and a second end;

a motor in said cylindrical roller, said motor having a motor shaft;

a support element projecting from said first end of said cylindrical roller;

a support shaft projecting from said second end of said cylindrical roller;

a bearing mechanism at each of said first end and said second end of said cylindrical roller for supporting each of said support element and said support shaft;

a sun gear on said motor shaft of said motor in said cylindrical roller;

a planet gear engaging said sun gear in said cylindrical roller;

a first inner tooth gear on an inner circumference of said cylindrical roller and facing said planet gear; and a bearing element having a second inner tooth gear engaging said planet gear, and having said support shaft projecting from a side thereof opposite said motor;

wherein each of said support element and said support shaft is held by said holding portion of said lid such that said cylindrical roller is operable to move relative to said sheet receiver.

27. An electronic apparatus comprising:

a main body case including a lid, said lid having a holding portion with a slit;

a sheet receiver in said main body case;

a head for recording information on a printing sheet in said main body case; and a roller for holding the printing sheet against said sheet receiver, said roller including:

a cylindrical roller having a first end and a second end;

a driving element in said cylindrical roller;

a support element projecting from said first end of said cylindrical roller;

a support shaft projecting from said second end of said cylindrical roller; and a bearing mechanism at each of said first end and said second end of said cylindrical roller for supporting each of said support element and said support shaft;

wherein said support shaft has a flat portion slidably fitted in said slit of said holding portion, each of said support element and said support shaft being held by said holding portion of said lid such that said cylindrical roller is operable to move relative to said sheet receiver, said holding portion including a pressing element for pressing at least one of said support element and said support shaft towards sheet receiver.

28. An electronic apparatus comprising:

a main body case including a lid, said lid having a holding portion;

a sheet receiver in said main body case;

a head for recording information on a printing sheet in said main body case; and a roller for holding the printing sheet against said sheet receiver, said roller including:

a cylindrical roller having a first end and a second end;

motor in said cylindrical roller, said motor having a motor shaft;

a support element projecting from said first end of said cylindrical roller;

a support shaft projecting from said second end of said cylindrical roller;

a bearing mechanism at each of said first end and said second end of said cylindrical roller for supporting each of said support element and said support shaft;

a sun gear on said motor shaft of said motor in said cylindrical roller;

a planet gear engaging said sun gear in said cylindrical roller;

a first inner tooth gear on an inner circumference of said cylindrical roller and facing said planet gear; and a bearing element having a second inner tooth gear engaging said planet gear, and having said support shaft projecting from a side thereof opposite said motor;

wherein each of said support element and said support shaft is held by said holding portion of said lid such that said cylindrical roller is operable to move relative to said sheet receiver, said holding portion including a pressing element for pressing at least one of said support element and said support shaft towards sheet receiver.

29. An electronic apparatus comprising:

a main body case including a lid, said lid having a holding portion with a slit;

a sheet receiver in said main body case, said sheet receiver including a head on a surface thereof for recording information on a printing sheet in said main body case, said head including a heating element; and a roller for holding the printing sheet against said head of said sheet receiver, said roller including:
a cylindrical roller having a first end and a second end;
a driving element in said cylindrical roller;
a support element projecting from said first end of said cylindrical roller;
a support shaft projecting from said second end of said cylindrical roller; and
a bearing mechanism at each of said first end and said second end of said cylindrical roller for supporting each of said support element and said support shaft;
wherein said support shaft has a flat portion slidably fitted in said slit of said holding portion, said support shaft and said support element being held by said holding portion such that said cylindrical roller is operable to move relative to said sheet receiver.

30. An electronic apparatus comprising:

a main body case including a lid, said lid having a holding portion with a slit;

a sheet receiver in said main body case, said sheet receiver including a head on a surface thereof for recording information on a printing sheet in said main body case, said head including a heating element; and a roller for holding the printing sheet against said head of said sheet receiver, said roller including:
a cylindrical roller having a first end and a second end;
a motor in said cylindrical roller, said motor having a motor shaft;
a support element projecting from said first end of said cylindrical roller;
a support shaft projecting from said second end of said cylindrical roller;
a bearing mechanism at each of said first end and said second end of said cylindrical roller for supporting each of said support element and said support shaft;
a sun gear on said motor shaft of said motor in said cylindrical roller;
a planet gear engaging said sun gear in said cylindrical roller;
a first inner tooth gear on an inner circumference of said cylindrical roller and facing said planet gear; and
a bearing element having a second inner tooth gear engaging said planet gear, and having said support shaft projecting from a side thereof opposite said motor;
wherein each of said support element and said support shaft is held by said holding portion of said lid such that said cylindrical roller is operable to move relative to said sheet receiver.

31. An electronic apparatus comprising:

a main body case including a lid, said lid having a holding portion with a slit;

a sheet receiver in said main body case;

a head for recording information on a printing sheet in said main body case; and a roller for holding the printing sheet against said sheet receiver, said roller including:
a cylindrical roller having a first end and a second end;
a driving element in said cylindrical roller;
a support element projecting from said first end of said cylindrical roller;
a support shaft projecting from said second end of said cylindrical roller; and
a bearing mechanism at each of said first end and said second end of said cylindrical roller for supporting each of said support element and said support shaft;
wherein said support shaft has a flat portion slidably fitted in said slit of said holding portion, said support shaft and said support element being held by said holding portion of said lid such that said cylindrical roller is operable to move relative to said sheet receiver.

32. An electronic apparatus comprising:

a main body case including a lid, said lid having a holding portion;

a sheet receiver in said main body case;

a head for recording information on a printing sheet in said main body case; and a roller for holding the printing sheet against said sheet receiver, said roller including:
a cylindrical roller having a first end and a second end;
a motor in said cylindrical roller, said motor having a motor shaft;
a support element projecting from said first end of said cylindrical roller;
a support shaft projecting from said second end of said cylindrical roller;
a bearing mechanism at each of said first end and said second end of said cylindrical roller for supporting each of said support element and said support shaft;
a sun gear on said motor shaft of said motor in said cylindrical roller;
a planet gear engaging said sun gear in said cylindrical roller;
a first inner tooth gear on an inner circumference of said cylindrical roller and facing said planet gear; and
a bearing element having a second inner tooth gear engaging said planet gear, and having said support shaft projecting from a side thereof opposite said motor;
wherein each of said support element and said support shaft is held by said holding portion of said lid such that said cylindrical roller is operable to move relative to said sheet receiver.

33. An electronic apparatus comprising:

a U-shaped frame having a bottom plate and having side plates extending upward from said bottom plate;

a head on said bottom plate of said frame; and a cylindrical roller supported between said side plates of said frame, said cylindrical roller having a first end and a second end, and including:
a first support shaft at said first end;
a motor connected to said first support shaft, and having a motor shaft;
a sun gear on said motor shaft of said motor;
a planet gear engaging said sun gear;
a first inner tooth gear inside of said cylindrical roller and facing said planet gear;
a bearing element having a second inner tooth gear engaging said planet gear;
a second support shaft connected to said bearing element and arranged at said second end of said cylindrical roller; and
a bearing mechanism for rotatably supporting said cylindrical roller on said first support shaft and said second support shaft.

34. The electronic apparatus of claim 33, wherein said head comprises a plate-shaped thermal head.

35. The electronic apparatus of claim 34, wherein said thermal head is mounted on said bottom plate via an elastic element.

36. The electronic apparatus of claim 35, wherein said elastic element comprises a mounting plate bent and raised from said bottom plate so as to be elastic, said thermal head being mounted on said mounting plate.

* * * * *

UNITED STATES PATENT AND TRADEMARK OFFICE

CERTIFICATE OF CORRECTION

PATENT NO. : 6,688,787 B2
DATED : February 10, 2004
INVENTOR(S) : Toru Arakawa et al.

It is certified that error appears in the above-identified patent and that said Letters Patent is hereby corrected as shown below:

Column 16,
Line 38, please replace “motor in said cylindrical” with -- a motor in said cylindrical --.

Signed and Sealed this

Twenty-eighth Day of December, 2004

JON W. DUDAS
*Director of the United States Patent and Trademark Office*